US007410741B2

(12) United States Patent
Daimon et al.

(10) Patent No.: US 7,410,741 B2
(45) Date of Patent: Aug. 12, 2008

(54) TONER FOR ELECTROPHOTOGRAPHY AND DEVELOPER FOR ELECTROPHOTOGRAPHY, AS WELL AS IMAGE FORMING METHOD

(75) Inventors: Katsumi Daimon, Minamiashigara (JP); Norihito Fukushima, Minamiashigara (JP); Shuji Sato, Minamiashigara (JP); Masaaki Suwabe, Minamiashigara (JP); Kazufumi Tomita, Minamiashigara (JP); Fumio Ojima, Minamiashigara (JP)

(73) Assignee: Fuji Xerox Co., Ltd, Tokyo (JP)

( * ) Notice: Subject to any disclaimer, the term of this patent is extended or adjusted under 35 U.S.C. 154(b) by 408 days.

(21) Appl. No.: 11/158,248

(22) Filed: Jun. 22, 2005

(65) Prior Publication Data

US 2006/0194136 A1 Aug. 31, 2006

(30) Foreign Application Priority Data

Feb. 28, 2005 (JP) ..... 2005-054469

(51) Int. Cl.
*G03G 9/08* (2006.01)

(52) U.S. Cl. ..... 430/109.4; 430/123.5

(58) Field of Classification Search ..... 430/109.4, 430/123.5

See application file for complete search history.

(56) References Cited

U.S. PATENT DOCUMENTS 5,747,211 A * 5/1998 Hagi et al. ..... 430/108.6

FOREIGN PATENT DOCUMENTS

| | | |
|---|---|---|
| JP | A 04-120554 | 4/1992 |
| JP | A 04-239021 | 8/1992 |
| JP | A 05-165252 | 7/1993 |
| JP | A 2001-117268 | 4/2001 |
| JP | A 2004-168827 | 6/2004 |

* cited by examiner

*Primary Examiner*—Mark A Chapman
(74) *Attorney, Agent, or Firm*—Oliff & Berridge, PLC

(57) ABSTRACT

A toner for electrophotography contains a binder resin and a coloring agent, and is characterized in that the binder resin contains a crystalline polyester resin, and a low-molecular compound having at least one of a naphthalene skeleton and a biphenyl skeleton, and the crystalline polyester resin contains 0.5 to 30 construction mole % of an aromatic dicarboxylic acid-derived constitutional component. Further, a developer for electrophotography and an image forming method using the toner for electrophotography are disclosed.

19 Claims, 2 Drawing Sheets

TONER FOR ELECTROPHOTOGRAPHY AND DEVELOPER FOR ELECTROPHOTOGRAPHY, AS WELL AS IMAGE FORMING METHOD

CROSS-REFERENCE TO RELATED APPLICATION

This application claims priority under 35 USC 119 from Japanese Patent Application No. 2005-054469, the disclosure of which is incorporated by reference herein.

BACKGROUND OF THE INVENTION

1. Field of the Invention

The present invention relates to a toner for electrophotography and a developer for electrophotography which can be utilized in an electrophotography device utilizing an electrophotography process such as a copying machine, a printer, or a facsimile, as well as to an image forming method.

2. Description of the Related Art

Regarding electrophotography methods, many methods are already known (see, for example, Japanese Patent Application Publication (JP-B) No. 42-23910). Generally, a fixed image is formed after a plurality of steps of electrically forming a latent image on a surface of a photoreceptor (latent image retaining body) utilizing a photoconductive substance by a variety of means, developing the formed latent image using a toner for electrophotography (hereinafter, also simply referred to as "toner") to form a toner image, transferring the toner image on the photoreceptor surface onto a surface of a recording material to such as paper via or not via an intermediate transfer body, and fixing this transferred image by heating, pressurizing, heating and pressurizing or a solvent steam. Toner remaining on the photoreceptor surface is cleaned by various methods if necessary, and is re-supplied to the aforementioned plural steps.

As a fixing technique for fixing a transferred image which has been transferred onto a surface of a recording material, a thermal roll fixing method of inserting a transfer material onto which a toner image has been transferred between a pair of rolls composed of a heating roll and a pressure roll to fix the image is common. In addition, as a like technique, a technique in which one or both of the rolls is substituted with a belt is also known. In these techniques, an image that is fixed fast can be obtained at high speed, energy efficiency is high, and damage to environment due to solvent volatilization or the like is minimal, as compared with other fixing methods.

On the other hand, in order to reduce the amount of energy to be used in a copying machine and a printer, a technique for fixing a toner using less energy is desired. For this reason, there is a great demand for a toner for electrophotography which can be fixed at a lower temperature.

As a means to lower the temperature for fixing a toner, a technique of lowering the glass transition point of a resin for a toner (binder resin) is usually implemented. However, when the glass transition point is too low, aggregation of a powder (blocking) is facilitated, and retainability of a toner on a surface of a fixed image is impaired and, therefore, practically, the lower limit is 50° C. This glass transition point is a design feature of resins for toner which are currently widely commercially available, and it has not been possible to obtain a toner which can be fixed at a yet further reduced temperature by means of further lowering the glass transition point. In addition, although the fixing temperature can be lowered by using a plasticizer, blocking occurs during storage of a toner or in a developing machine.

As a means for preventing blocking and realizing both image retainability up to 60° C. and low temperature fixability, a technique using a crystalline resin as a binder resin constituting a toner has been considered, and a method of using a crystalline resin as a toner for the purpose of realizing both blocking prevention and low temperature fixing has been long known (see, for example, JP-B No. 56-13943). In addition, for the purpose of offset prevention and pressure fixing, a technique of using a crystalline resin has been long known (see, for example, JP-B Nos. 62-39428 and 63-25335).

However, when in the above-disclosed techniques, for example, a polymer having an alkyl group side chain of a carbon number of 14 or more is applied to a toner, while the melting point thereof is low, at 62 to 66° C., this temperature is too low and, thus, there are problems of reliability of powder and images. When other crystalline resins are used, fixing performance on paper is not sufficient.

Examples of a crystalline resin for which improvement in fixability on a paper is expected include polyester resins. As a technique of using a crystalline polyester resin in a toner, technique of using a mixture of a non-crystalline polyester resin having a glass transition temperature of 40° C. or higher and a crystalline polyester resin having a melting point of 130 to 200° C. has been proposed (see, for example, JP-B No. 62-39428). In this technique, excellent fine grindability and blocking resistance are achieved. However, since the melting point of the crystalline polyester resin is high, fixing a yet further reduced temperature cannot be attained.

In order to solve the above problems, a technique using a crystalline resin having a melting point of 110° C. or lower, and using a toner with a non-crystalline resin mixed therein has been proposed (see, for example, JP-B No. 4-30014). However, when a non-crystalline resin is mixed in a crystalline resin, depression of the melting point of the toner occurs, thus, toner blocking occurs, and retainability of an image is deteriorated. When the non-crystalline resin component is large, since the properties of the non-crystalline resin component are greatly reflected, it is difficult to reduce the fixing temperature further than previously. For these reasons, unless a only crystalline resin is used as a resin for a toner, or a non-crystalline resin is mixed in an extremely small amount, practical use is difficult.

In view of the foregoing, it is desirable to use only crystalline polyester resin as far as possible in thermal roll fixing, and some examples using crystalline polyester resin have been proposed (see, for example, Japanese Patent Application Laid-open (JP-A) Nos. 4-120554, 4-239021, and 5-165252). However, in these techniques, the crystalline polyester resins are resins in which alkylene glycol or alicyclic alcohol having a small carbon number is used relative to a carboxylic acid component of terephthalic acid.

These polyester resins are described as crystalline polyester resins in the above references. However, since these polyester resins are essentially partial crystalline polyester resins, change in a viscosity relative to the temperature of a toner (resin) is not steep, and there are no problems in blocking property and image retainability. However, low temperature fixing cannot be realized in thermal roll fixing.

On the other hand, the present inventors have showed that a toner containing a crystalline polyester resin having a crosslinked structure as the main component is excellent in blocking resistance and image retainability, and can realize low temperature fixing (see, for example, JP-A No. 2001-117268). However, in such a toner, further improvement in charging property was desired in, particularly, two-component charging with a carrier.

Then, it was shown that a toner for electrophotography containing, as the main component, a crystalline polyester resin in which an ester concentration M of a crystalline polyester resin defined in the following equation (1) is not less than 0.01 and not more than 0.12, in the binder resin, can be obtained as a toner having further improved charging property (see, for example, JP-A No. 2002-82845).

$$M=K/A \quad \text{equation (1)}$$

(in the equation (1), M represents an ester concentration, K represents the number of ester groups in a polymer, and A represents the number of atoms constituting a polymer chain of a polymer)

On the other hand, in the specification of the above disclosure, a process for producing a toner for electrophotography is shown, comprising emulsifying a crystalline polyester resin containing, as a copolymerization component, 2 to 20 mole % of a di- or more valent carboxylic acid having a sulfonic acid group in which the ester concentration M is not less than 0.01 and not more than 0.12, and aggregating and fusing this to adjust to a toner diameter. In this case, it is described that preparation of a self-emulsifying solution of polyester is possible, particle size distribution of a toner obtained by the aggregation and incorporation is narrow, and transferring property thereof is better.

However, it was discovered that a toner prepared by an aggregating and incorporating method using this crystalline resin copolymerized with carboxylic acid having a sulfone group has a low charging property under high temperature and high humidity. While adjustment of the charging property can also be performed by using an external additive, improved charging property is preferable. Accordingly, it was desirable to find a new composition of a crystalline polyester resin in which charging property under high temperature and high humidity is maintained while low temperature fixing is realized, and an aggregation and incorporation method can be applied. Thus, a crystalline polyester resin has been proposed which is characterized in that two or more kinds of dicarboxylic acid-derived consitutional components are included as an acid-derived consitutional component constituting a polymer and the content of an aromatic dicarboxylic acid-derived consitutional component having no sulfonic acid group is in the range of 0.5 to 30 construction mole % of all acid-derived consitutional components. Further, when a dicarboxylic acid-derived consitutional component having a sulfonic acid group is included, the content of the dicarboxylic acid-derived consitutional component having a sulfonic acid group is 5 construction mole % or less of all acid-derived consitutional components. (See, for example, JP-A No. 2004-168827.)

However, a toner using this resin has a defect in that it is easily crushed and, when it remains on a photoreceptor, it cannot withstand a force received between a cleaning blade and an intermediate transference drum, is deformed, and remains on a photoreceptor or an intermediate transference drum. As a result, filming is encouraged on a photoreceptor or an intermediate transference body.

SUMMARY OF THE INVENTION

A first aspect of the present invention provides a toner for electrophotography comprising a binder resin and a coloring agent, characterized in that the binder resin contains a crystalline polyester resin, and a low-molecular compound having at least one of a naphthalene skeleton and a biphenyl skeleton, and the crystalline polyester resin contains 0.5 to 30 construction mole % of an aromatic dicarboxylic acid-derived constitutional component.

A second aspect of the invention provides a developer for electrophotography comprising a toner for electrophotography and a carrier, characterized in that the tone for electrophotography is a toner for electrophotography according to the first aspect.

A third aspect of the invention provides an image forming method, comprising forming an electrostatic latent image on a surface of a latent image retaining body, developing the electrostatic latent image with a developer to form a toner image, transferring the toner image formed on the surface of the latent image retaining body onto a recording material to form a transferred image, and fixing the transferred image transferred onto the recording material, wherein the developer contains a toner for electrophotography according to the first aspect.

DETAILED DESCRIPTION OF THE INVENTION

Figure 1:
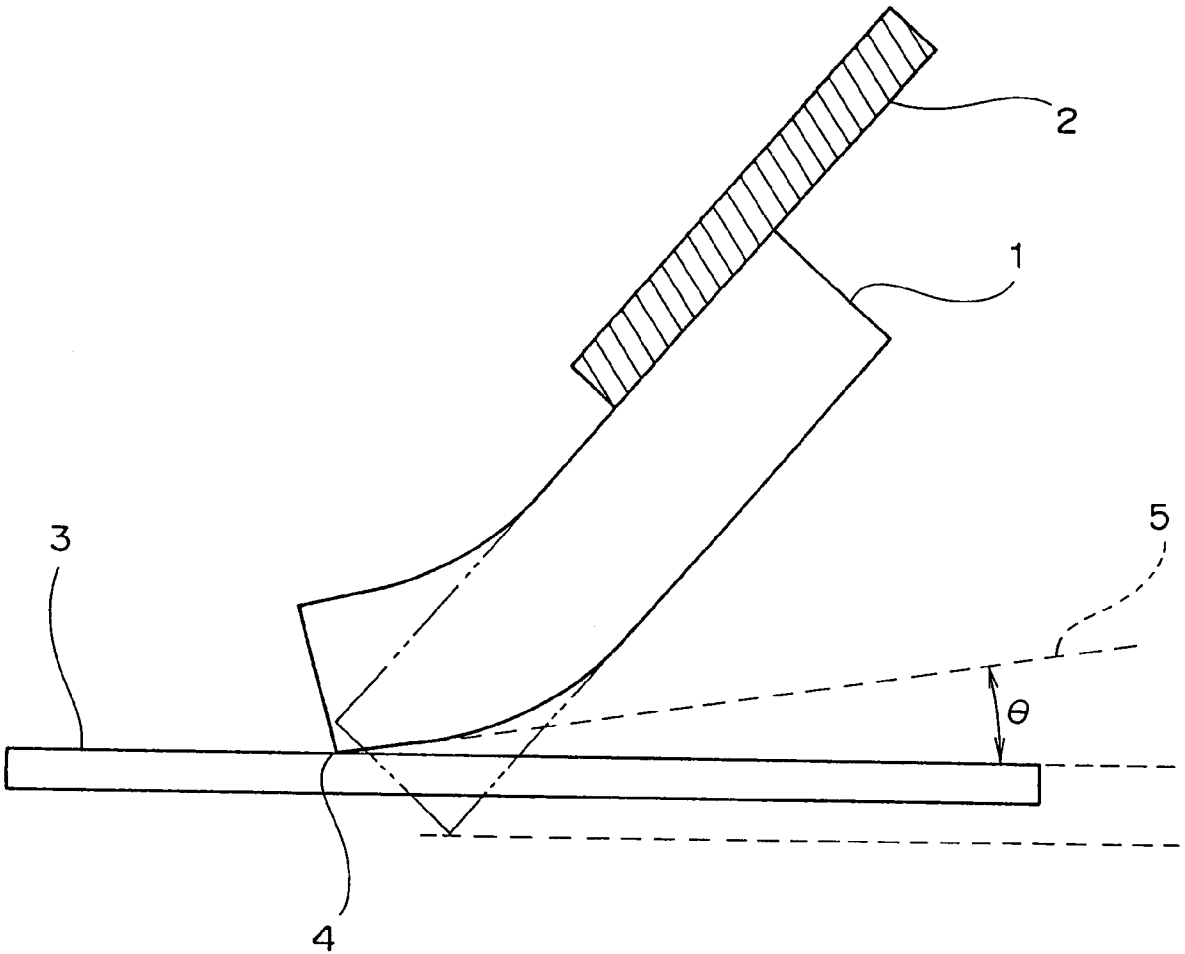
FIG. 1 is an illustration view for explaining cleaning treatment relating to the image forming method of the present invention.

The aforementioned objects can be attained by the following invention. That is, the invention is:

<1> A toner for electrophotography comprising a binder resin and a coloring agent, characterized in that the binder resin contains a crystalline polyester resin, and a low-molecular compound having at least one of a naphthalene skeleton and a biphenyl skeleton, and the crystalline polyester resin contains 0.5 to 30 construction mole % of an aromatic dicarboxylic acid-derived constitutional component.

<2> A developer for electrophotography comprising a toner for electrophotography and a carrier, characterized in that the toner for electrophotography is a toner for electrophotography of the invention.

<3> An image forming method, comprising forming an electrostatic latent image on a surface of a latent image retaining body, developing the electrostatic latent image with a developer to form a toner image, transferring the toner image formed on the surface of the latent image retaining body onto a recording material to form a transferred image, and fixing the transferred image transferred onto the recording material, wherein the developer contains the toner for electrophotography of the invention.

In the image forming method of the invention, a cleaning step is preferably further included, cleaning treatment in the cleaning step is cleaning treatment of removing a toner remaining on a surface of the photoreceptor after via the developing step and the transferring step, and it is preferable that any of the following conditions (1) to (3) is satisfied.

(1) A thickness of an electrically conductive substrate of the photoreceptor is not less than 1.4 mm and not more than 2.2 mm.

(2) A cleaning means in cleaning treatment is retained in a supporting member, and has an elastic blade abutted against a surface of a photoreceptor at an abutting pressure of a linear pressure of not less than 20 g/cm and not more than 40 g/cm.

(3) An abutting angle of the elastic blade is not less than 9° and not more than 17°.

According to the invention, a toner for electrophotography and a developer for electrophotography which have better charging property and are deformed with difficulty in a developing machine while low temperature fixing is realized, as well as an image forming method can be provided.

The toner for electrophotography, the developer for electrophotography, and the image forming method of the invention will be explained in detail below.

[1] Toner for Electrophotography

The toner for electrophotography of the invention contains a binder resin and a coloring agent, and the binder resin contains a crystalline polyester resin, and a prescribed low-molecular compound. Each constitutional component of the toner for electrophotography of the invention will be explained.

<Binder Resin>

A binder resin in the toner for electrophotography of the invention contains a crystalline polyester resin as a main component. In this specification, the "main component" refers to a main component among components constituting the binder resin, specifically, refers to a component constituting not less than 50% by mass of the binder resin. In the invention, among the binder resin, a crystalline polyester resin is a binder resin at preferably 70% by mass or more, more preferably 80% by mass or more.

(Crystalline Polyester Resin)

A crystalline polyester resin is a specified polyester resin which is synthesized from an acid (dicarboxylic acid) and alcohol (diol) component.

In explanation later, in a polyester resin, a constitutional site which was an acid component before synthesis of a polyester resin is referred to "acid-derived constitutional component" and a constitutional site which was an alcohol component before synthesis of polyester resin is referred to as "alcohol-derived constitutional component", respectively.

As described above, the polyester resin is a crystalline polyester resin. When the resin is not crystalline, that is, when it is non-crystalline, toner blocking resistance and image retainability can not be maintained while better low temperature fixability is maintained.

In the invention, "crystalline" in "crystalline polyester resin" refers to not a stepwise change in endotherm but possession of a clear endothermic peak in differential scanning calorimetery (DSC). In addition, an endothermic peak refers to a peak having a width of 40 to 50° C. when formulated into a toner, in some cases. In the case of a polymer in which other component is copolymerized with the main chain of the polyester, when other component is not more than 50% by mass, this copolymer is also called crystalline polyester.

—Acid-Derived Constitutional Component—

Examples of an acid which is to be the acid-derived constitutional component include various dicarboxylic acids. As a main acid-derived constitutional component in a specified polyester resin, aliphatic dicarboxylic acid and aromatic dicarboxylic acid are desirable and, in particular, aliphatic dicarboxylic acid is desirably a straight-chain type dicarboxylic acid.

In the invention, it is preferable that a crystalline polyester resin contains two or more kinds of decarboxlyic acid-derived constitutional components as the acid-derived constitutional component. By inclusion of two or more kinds of dicarboxylic acid-derived constitutional components, for example, emulsifying property in an emulsification aggregating method described later can be made better.

Examples of aliphatic dicarboxylic acid include oxyalic acid, malonic acid, succinic acid, glutaric acid, adipic acid, pimelic acid, suberic acid, azelic acid, sebacic acid, 1,9-nonane dicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and a lower alkyl ester or an acid-anhydride thereof, being not limiting. Among them, in view of easy availability, sebacic acid, and 1,1-decanedicarboxylic acid are preferable.

Examples of aromatic dicarboxylic acid which is a copolymerization component necessary in the invention include terephthalic acid, isophthalic acid, orthophthalic acid, t-butylisophthalic acid, 2,6-naphthalinedicarboxylic acid and 4,4'-biphenyldicarboxylic acid. Among them, terephtalic acid, isophtalic acid, and t-butylisopthalic acid, and alkyl esters thereof are preferable in respect of easy availability, and easy formation of an easily-emulsifiable polymer.

From a viewpoint of emulsifying property in an emulsification aggregation method and charging stability when formulated into a toner, it is preferable that, as a constitutional component of a crystalline polyester resin, an aromatic dicarboxylic acid-derived constitutional component not having the aforementioned sulfonic acid group is contained.

A crystalline polyester resin (hereinafter, simply referred to as "polyester resin") contains 0.5 to 30 construction mole % of an aromatic dicarboxylic acid-derived constitutional component. When the component is contained exceeding 30 construction mole % of an acid-derived constitutional component in a polymer, crystallizability of a crystalline polyester resin is high, and a melting point is high, thereby, emulsifying property is deteriorated. On the other hand, when the amount is less than 0.5 construction mole %, emulsification property is deteriorated. Therefore, it is necessary that a content of an aromatic dicarboxylic acid-derived constitutional component among all acid-derived constitutional components in a polymer is in a range of 0.5 to 30 construction mole %. The content is preferably in a range of 1 to 15 construction mole %, more preferably in a range of 3 to 10 construction mole %.

A remaining acid-derived constitutional component in a polymer is constructed of the aforementioned aliphatic dicarboxylic acid-derived constitutional component except for the case where a dicarboxylic acid-derived component having a sulfonic acid group described later is contained.

In this specification, "construction mole %" refers to percentage letting the acid-derived constitutional component in all acid-derived constitutional components in a polyester resin, or the alcohol constitutional component in all alcohol-derived constitutional components to be 1 unit (mole), respectively.

As the acid-derived constitutional component, in addition to the aforementioned aliphatic dicarboxylic acid (main component)-derived constitutional component and aromatic dicarboxylic acid (copolymerization component)-derived constitutional component, constitutional components such as a dicarboxylic acid-derived constitutional component having a double bond, and a dicarboxylic acid-derived constitutional component having a sulfonic acid component may be contained.

A dicarboxylic acid-derived constitutional component having a double bond includes a constitutional component derived from a lower alkyl ester or an acid anhydride of dicarboxylic acid having a double bond, in addition to a constitutional component derived from dicarboxylic acid having a double bond. The dicarboxylic acid-derived constitutional component having a sulfonic acid group includes a constitutional component derived from a lower alkyl ester or an acid anhydride of dicarboxylic acid having a sulfonic acid group, in addition to a constitutional component derived from dicarboxylic acid having a sulfonic acid group.

Dicarboxylic acid having a double bond can be suitably used, in order to prevent hot offset at fixing step, in that it crosslinks a whole resin utilizing the double bond. Examples of such the dicarboxylic acid include fumaric acid, maleic acid, 3-hexenedioic acid, and 3-octenedioic acid, being not limiting. Additional examples include a lower alkyl ester, and an acid anhydride thereof. Among them, form a viewpoint of cost, fumaric acid and maleic acid are preferable.

A content of these dicarboxylic acid-derived constitutional components having a double bond in all acid-derived constitutional components is preferably 20 construction mole % or less, more preferably in a range of 2 to 10 construction mole %.

When the above mentioned content exceeds 20 construction mole %, crystallizability of a polyester resin is reduced, and a melting point is depressed, and retainability of an image is deteriorated in some cases.

Dicarboxylic acid having a sulfonic acid group is effective in that it can make dispersing a coloring material such as a pigment better. When a whole resin is emulsified or suspended in water to prepare a particle, if a sulfonic acid group is present, emulsification or suspension is possible without using a surfactant as described later. Examples of such the dicarboxylic acid having a sulfonic acid group include a sodium 2-sulfoterepthalate salt, a sodium 5-sulfoisophthalate salt, and a sodium sulfosuccinate salt, being not limiting. Additional examples include a lower alkyl ester, and an acid anhydride of them. Among them, from a viewpoint of a cost, a sodium 5-sulfoisophthalate salt is preferable.

When the dicarboxylic acid-derived constitutional component having a sulfonic acid group is contained in a polymer, it is necessary that a content of the dicarboxylic acid derived from constitutional component having a sulfonic acid group in all acid-derived constitutional components is 5 construction mole % or less. The content may be used in a range of 3 construction mole % or less.

When the content exceeds 5 construction mole %, hydrophilicity of a polyester resin is increased, and charging property of a toner under high humidity is deteriorated. Although it is not necessarily required to use as a copolymerization component, it is desirable to use it in order to assist in emulsification of a resin.

—Alcohol-Derived Constitutional Component—

As an alcohol which is to be an alcohol-derived constitutional component, an aliphatic diol is preferable, and a straight-chain type aliphatic diol having a chain carbon number in a range of 7 to 20 is more preferable.

Since crystallizability of a polyester resin is decreased, and a melting point is depressed when the aliphatic diol is a branch type, toner blocking resistance, image retainability, and lower temperature fixability are deteriorated in some cases. When the chain carbon number is less than 7, in the case where polycondensed with aromatic dicarboxylic acid, a melting point becomes higher, and low temperature fixing becomes difficult in some cases. On the other hand, when the chain carbon number exceeds 20, it easily becomes difficult to obtain a practical material. It is more preferable that a chain carbon number is 14 or less.

When polyester is obtained by polycondensing with aromatic dicarboxylic acid, it is preferable that the chain carbon number is an odd. When the chain carbon number is an odd, a melting point of a polyester resin becomes lower than the case where the chain carbon number is an even, and the melting point is easily a value in a numerical value range described later.

Examples of aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol, being not limiting. Among them, in view of easy availability, ethylene glycol, 1,4-butanediol, 1,6-hexanediol, 1,9-nonanediol, and 1,19-decanediol are preferable.

In an alcohol-derived constitutional component, a content of an aliphatic diol-derived constitutional component is 80 construction mole % or more and, if necessary, other component is contained. In an alcohol-derived constitutional component, it is more preferable that the content of an aliphatic diol-derived constitutional component is 90 construction mole % or more.

When a content of an aliphatic diol-derived constitutional component is less than 80 construction mole %, since crystallizability of a polyester resin is reduced, and a melting point is depressed, toner blocking resistance, image retainability, and low temperature fixability are deteriorated in some cases.

Other component which is contained as necessary includes constitutional components such as a diol-derived constitutional component having a double bond, and a diol-derived constitutional component having a sulfonic acid group. Examples of a diol having a double bond include 2-butene-1,4-diol, 3-hexene-1,6-diol, and 4-octene-1,8-diol.

A content of these diol-derived constitutional components having a double bond in all acid-derived constitutional components is preferably 20 construction mole % or less, more preferably 2 to 10 construction mole %. When the content exceeds 20 construction mole %, crystallizability of a polyester resin is deteriorated, a melting point is depressed, and retainability of an image are deteriorated in some cases.

Examples of a diol having a sulfonic acid group include a 1,4-dihydroxy-2-sulfonic acid benzene sodium salt, a 1,3-dihydroxymethyl-5-sulfonic acid benzene sodium salt, and a 2-sulfo-1,4-butanediol sodium salt.

A content of these diol-derived constitutional components having a sulfonic acid group in all acid-derived constitutional components is preferably 5 construction mole % or less, more preferably in a range of 0.5 to 3 construction mole %, and a minimum necessary amount is enough.

When the content exceeds 5 construction mole %, hydrophobicity of a crystalline resin is increased, and charging property of a toner under a high humidity is deteriorated. If not necessary, it is not necessary to use as a copolymerization component, and it is preferable to use an amount of a necessary minimum in order to assist in emulsifying a resin. Regarding a use amount, it is necessary to adjust an amount at a minimum together with a dicarboxylic acid component having a sulfonic acid group. When the dicarboxylic acid component having a sulfonic acid group is used as an acid component, it is not fundamentally necessary to use a diol having a sulfonic acid group.

When these alcohol-derived constitutional components other than an aliphatic diol-derived constitutional component (a diol-derived constitutional component having a double bond and a diol-derived constitutional component having a sulfonic acid group) is added, a content in these alcohol-derived constitutional components is preferably in a range of 1 to 20 construction mole %, more preferably in a range of 2 to 10 construction mole %.

A melting point of a crystalline polyester resin is preferably in a range of 60 to 120° C., more preferably in a range of 70 to 100° C. When a melting point is lower than 60° C., aggregation of a powder is easily caused, and retainability of a fixed image is deteriorated in some cases. On the other hand, when a melting point exceeds 120° C., lower temperature fixing becomes impossible in some cases.

In the invention, for measuring a melting point of a crystalline polyester resin, a differential scanning calorimetry (DSC) is used, and a top value of an endothermic peak when measured at a temperature raising rate of 10° C. per minute from room temperature to 150° C. is used.

A process for producing a crystalline polyester resin is not particularly limited, but the resin can be prepared by a general polyester polymerization method in which an acid component and an alcohol component are reacted, and a resin is prepared by selectively using a direct polycondensation method, and a transesterification method, depending on a kind of a monomer. A mole ratio (acid component/alcohol component) upon reaction of an acid component and an alcohol component is different on reaction condition and, therefore, it is not absolutely mentioned, but usually around 1/1.

It is preferable that preparation of a crystalline polyester resin is performed at a polymerization temperature of 180 to 230° C. and, if necessary, a reaction system is evacuated, and a reaction is performed while water and an alcohol produced at condensation are reduced. When a monomer is not dissolved or is not compatible under a reaction temperature, a high boiling point solvent is added as a solubilizer to dissolve the monomer. A polycondensation reaction is performed while a solulibizer is distilled off. When a monomer having worse compatibility is present in a copolymerization reaction, a monomer having worse compatibility and an acid or an alcohol which is to be polycondensed with a monomer are condensed in advance and, thereafter, a condensate may be polycondensed with a main component.

Examples of a catalyst which can be used at preparation of a crystalline polyester resin include an alkali metal compound such as sodium, and lithium, an alkaline earth metal compound such as magnesium, and calcium, a metal compound, a phosphite compound, and a phosphate compound of zinc, manganese, antimony, titanium, zinc, zirconium or germanium, and an amine compound, specifically, there are following compounds.

Examples include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zilconyl acetate, zirconyl stearate, zirconyl octylate, germanium oxide, triphenyl phosphite, tris(2,4-di-t-butylphenyl)phosphite, ethyltriphenylphosphinium bromide, triethylamine, and triphenylamine.

(Low-Molecular Compound)

Another important constitutional element of the invention is a low-molecular compound having a naphthalene skeleton or a biphenyl skeleton. By inclusion of the low-molecular compound, a hardness of a toner for electrophotography is improved, and a toner becomes difficult to be deformed and, at the same time, charging property can be better. This is thought to be due to that the low-molecular compound enters an amorphous part of a crystalline polyester resin, and suppresses a motion of a molecule at the part. As a result, a hardness of a whole toner for electrophotography is improved, and it is considered that charging property is improved due to non-movement of a molecule.

Examples of a low-molecular compound having a biphenyl skeleton include biphenyl, 4-biphenylacetic acid, 4-biphenylcarbonitrile, 2-biphenylcarboxylic acid, 4-biphenylcarboxylic acid, and 4,4'-biphenyldicarboxylic acid, and a lower alkyl ester thereof. Any compound may be used as far as it is a compound having a biphenyl skeleton and having a melting point of 70° C. or higher and, from a viewpoint that introduction is possible at synthesis of a polyester, 4-biphenylacetic acid, 4-biphenylcarboxylic acid, 4,4'-biphenyldicarboxylic acid, and a lower alkyl ester thereof (for example, dimethyl 4,4'-biphenyldicarboxylate) are preferable.

As a low-molecular compound having a naphthalene skeleton, any compound may be used as far as it is a compound having a naphthalene skeleton and a melting point of 70° C. or higher, such as naphthalene, naphthaleneacetic acid, 2,6-naphthalenedicarboxylic acid, and 1-naphthalenesulfonic acid, and a lower alkyl ester thereof and, from a viewpoint that introduction is possible at synthesis of a polyester, naphthaleneacetic acid, 2,6-naphthalenedicarboxylic acid and a methyl ester thereof (for example, dimethyl 2,6-naphthalenedicarboxylate) are preferable.

Most preferable examples of a low-molecular compound having a biphenyl skeleton include compounds represented by the following formulas (1) to (3) from a viewpoint that compatibility with a resin is important.

[formula 1]

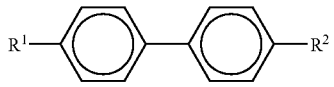

[formula 2]

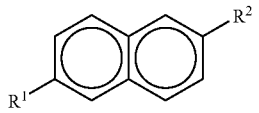

[formula 3]

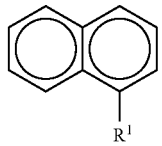

In the above formulas (1) to (3), it is preferable that $R^1$ and $R^2$ are independently a substituent represented by "—$COOR^3$", "—$CH_2COOR^4$" or "—$CONHR^5$". It is preferable that $R^3$, $R^4$ and $R^5$ are independently hydrogen, an alkyl group of $C_1$ to $C_{12}$.

Such the low-molecular compounds can be used alone, or two or more kinds can be used together. A content of a low-molecular compound (total content when two or more kinds are used jointly) is preferably 1 to 12 parts by mass, more preferably 3 to 10 parts by mass, further preferably 5 to 8 parts by mass relative to 100 parts by mass of a crystalline polyester resin. When the content is less than 1 part by mass, a hardness of a resin may not be increased, and a resin is easily deformed in some cases. Further, even when the content exceeds 12 parts by mass, hardness may not be increased, and a resin is easily deformed in some cases. It is important that a suitable amount in the above range is present by being well dispersed in a resin.

<Coloring Agent>

A coloring agent in the toner for electrophotography of the invention is not particularly limited, but examples include the known coloring agents, and a coloring agent can be appropriately selected depending on the purpose. A pigment may be used alone, or two or more kinds of the same series of pigments may be used by mixing. Alternatively, two or more kinds of different pigments may be used by mixing. Specific examples of the coloring agent include carbon black such as furnace black, channel black, acetylene black, and thermal black; aniline black; inorganic pigments such as red iron oxide, ultramarine blue, titanium oxide, and magnetic powder; azo pigments such as fast yellow, monoazo yellow, disazo yellow, pyrazolone red, chelate red, brilliant carmine (3B, 6B, etc.), and parabrown; phthalocyanine pigments such as copper phthlocyanine, and metal-free phthalocyanine; fused polycyclic pigments such as flavantron yellow, dibromoanthron orange, perylene red, quinacridone red, and dioxazine violet.

Additional examples include various pigments such as chromo yellow, hanza yellow, benzidine yellow, threne yellow, quinoline yellow, permanent orange GTR, pyrazolone orange, Vulcan orange, Watchung red, permanent red, DuPont oil red, lithol red, rhodamine B lake, lake red C, rose Bengal, aniline blue, ultramarine blue, chalco oil blue, methylene blue chloride, phthalocyanine blue, phthalocyanine green, malachite green oxalate, and parabrown; various dyes such as acrizine series, a xanthene series, an azo series, a benzoquinone series, an azine series, an anthraquinone series, a dioxazine series, a thiazine series, an azomethine series, an indigo series, a thioindigo series, a phthalocianine, aniline black series, polymethine series, a triphenylmethane series, a diphenylmethane series, a thiazole series and a xanthine series. A black pigment, or a dye may be mixed in these coloring agents to an extent that transparency is not reduced. Additional examples include a dispersion dye, and an oil-soluble dye.

A content of a coloring agent in a toner for electrophotography of the invention is preferably in a range of 1 to 30 parts by mass relative to 100 parts by mass of the binder resin, and as greater content as possible in such the numerical range is preferable in such a range that smoothness of an image surface after fixing is not deteriorated. When a content of a coloring agent is increased, this is advantageous in that, upon obtaining of an image of the same concentration, a thickness of an image can be decreased, and offset is effectively prevented. By appropriately selecting a kind of a coloring agent, each color toner such as a yellow toner, a magenta toner, a cyan toner, and a black toner is obtained.

<Other Components>

Other component which can be used in a toner for electrophotography of the invention is not particularly limited, but can be appropriately selected depending on the purpose, and examples include the known various additives such as inorganic particles, organic particles, charge controlling agents, and releasing agents.

The inorganic particle is generally used for the purpose of improving flowability of a toner. Examples of the inorganic particle include particles such as silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. Among them, a silica particle is preferable, and a hydrophobicized silica particle is particularly preferable.

An average primary particle diameter (number average particle diameter) of an inorganic particle is preferably in a range of 1 to 1,000 nm, and an addition amount (external addition) is preferably in a range of 0.01 to 20 parts by mass relative to 100 parts by mass of a toner.

An organic particle is generally used for the purpose of improving cleanability and transferability and, occasionally, charging property. Examples of the organic particle include particles of polystyrene, polymethyl methacrylate, polyfluorinated vinylidene, and styrene-acryl copolymer.

A charge controlling agent is generally used for the purpose of improving charging property. Examples of a charge controlling agent include a salicylic acid metal salt, metal-containing azo compound, nigrosine and a quaternary ammonium salt.

A releasing agent is generally used for the purpose of improving relesability. Examples of a releasing agent include low-molecular polyolefins such as polyethylene, polypropylene and polybutene; silicones having a softening point by heating; aliphatic amines such as oleic acid amide, erucic acid amide, ricinolic acid amide, and stearic acid amide; vegetable waxes such as carnauba wax, rice wax, candelilla wax, Japan wax, and jojoba oil; animal waxes such as beewax; mineral and petroleum waxes such as montan wax, ozokerite, seresin, paraffin wax, microcrystalline wax, and Fischer-Tropsch wax; ester waxes such as fatty acid ester, montanoic acid ester, and carboxylic acid ester. In the invention, these releasing agents may be used alone, or two or more kinds may be used jointly.

An addition amount of these releasing agents is preferably in a range of 0.5 to 50% by mass, more preferably in a range of 1 to 30% by mass, further preferably in a range of 5 to 15% by mass relative to a total amount of a toner. When an addition amount is less than 0.5% by mass, there may not be the effect of addition of a releasing agent and, when an addition amount exceeds 50% by mass, influence on charging property easily appears, a toner may easily be destructed in a developing machine, spentation of a releasing agent into a carrier may occur, and influence such as easy reduction in charging may appear and, for example, when a color toner is used, bleeding on a image surface at fixing may easily become in sufficient, and a releasing agent may easily reside in a image, therefore, transparency may be deteriorated, being not preferable.

<Other Construction>

In the toner of electrophotography of the invention, a surface thereof may be covered with a surface layer. It is desirable that a surface layer does not greatly influence on kinetic properties, and melt viscoelasticity properties of a whole toner. For example, when a non-melt or high melting point surface layer covers a toner at a large thickness, low temperature fixability due to use of a crystalline polyester resin may not be sufficiently exerted. Therefore, a thickness of a surface layer is desirably as small as possible, specifically, is preferably in a range of 0.001 to 1 μm.

In order to form a thin surface layer in the above range, a method of chemically treating a surface of a particle containing a binder resin, a particle thereof, a coloring agent and, if necessary, an inorganic particle, and other material is suitably used.

Examples of a component constituting a surface layer include a silane coupling agent, isocyanates, a vinyl-based monomer, a resin, and a particle thereof. It is preferable that a polar group is introduced into a component and, by chemical bonding, an adhering force between a toner and a material to be recorded such as a paper is increased.

As a polar group, any group may be used as far as it is a polarizing functional group, and examples include a carboxyl group, a carbonyl group, an epoxy group, an ether group, a hydroxyl group, an amino group, an imino group, a cyano group, an amido group, an imido group, an ester group, and a sulfone group.

Examples of a chemically treating method include a method of oxidation with a strong oxidizing substance such as peroxide, ozone oxidation, or plasma oxidation, and a method of binding a polymerizable monomer containing a polar group by graft polymerization or seed polymerization.

In addition, a surface layer may be provided by attaching the previous substance to a particle surface of a toner chemically or physically. For example, a resin particle may be coated on an outer side of a toner mother particle by mixing a resin particle together with a toner, using a mechanical force, and such the method is suitable for adjusting charging property of a toner mother particle. Examples of the resin particle include a styrene resin, a styrene-acryl copolymer and a polyester resin. Examples of a mixer upon use of coating include a sample mill, a Henschel mill, a V blender and a hybridizer.

In addition, a particle such as a metal, a metal oxide, a metal salt, a ceramic, a resin, a resin particle, and carbon black may be further externally added for the purpose of improving charging property, electrical conductivity, powder flowability, and lubricating property.

A volume average particle diameter of the toner for elctrophotography of the invention is preferably in a range of 1 to 20 μm, more preferably in a range of 2 to 8 μm. A number average particle diameter is preferably in a range of 1 to 20 μm, more preferably in a range of 2 to 8 μm.

A volume average particle diameter and a number average particle diameter can be obtained by measuring as a 50 μm aperture diameter using a coulter counter [TA-II] type (manufactured by Beckmann-Coulter Co.). Thereupon, measurement is performed after a toner is dispersed in an aqueous electrolyte solution (Isotron II: manufactured by Beckmann-Coulter Co.), and is dispersed for 30 seconds or longer by an ultrasound.

<Preferable Physical Properties of Toner for Electrophotography of the Invention>

It is desired that a toner used in the invention has a sufficient hardness under a normal temperature. Specifically, it is desirable that its dynamic viscoelasticity is such that a storage elastic modulus GL (30) is $1\times10^6$ Pa or larger, and a loss elastic modulus GN (30) is $1\times10^6$ Pa or larger at an angle frequency of 1 rad/sec, a strain of 0.1% and 30° C. A storage elastic modulus GL and a loss elastic modulus GN are specified in JIS K-6900 in detail.

When a storage elastic modulus GL(30) is less than $1\times10^6$ Pa, or a loss elastic modulus GN (30) is less than $1\times10^6$ Pa at an angle frequency of 1 rad/sec and 30° C., in the case where mixed with a carrier in a developing equipment, a toner particle may be deformed by a pressure or a shearing force undergoing from a carrier, and stable charging developing property may not be maintained in some cases. In addition, when a toner on a surface of a latent image carrier (photoreceptor) is cleaned, a toner is deformed by a shearing force undergoing from a cleaning blade, and cleaning defect may also be caused in some cases.

In the case where a storage elastic modulus GL (30) and a loss elastic modulus GN (30) are in the aforementioned range at an angle frequency of 1 red/sec and 30° C., even when used in a high speed electrophotography apparatus, property at fixing is stabilized, being preferable.

It is preferable that a toner for electrophotography of the invention has a melting point in a range of a temperature region of 60 to 120° C. Since a viscosity of a specified polyester resin is rapidly reduced at a boundary of a melting point, when stored at a temperature of a melting point or higher, a toner may be aggregated, causing blocking. Then, it is preferable that a melting point of the toner for electrophotography of the invention containing, as a main component of a binder resin, the specified polyester resin (crystalline polyester resin) is a temperature higher than a temperature to which the toner is exposed at storage or use, that is, 60° C. or higher. On the other hand, when a melting point is higher than 120° C., it becomes difficult to attain low temperature fixing in some cases. It is more preferable that the toner for eletrophotography of the invention has a melting point in a range of a temperature region of 70 to 100° C.

A melting point of the toner for electrophotography of the invention can be obtained as a melting peak temperature of input compensation differential scanning calorimetry shown in JIS K-7121. A crystalline resin shows a plurality of melting peaks in some cases, but in the invention, a maximum peak is regarded as melting point.

Further, it is preferable that the toner in the invention has an interval of a temperature that a variation of values of a storage elastic modulus GL and the loss elastic modulus GN due to a temperature change becomes two order or more in a temperature range of 10° C. (an interval of a temperature that, when a temperature is raised by 10° C., a value of GL and GN is changed to a 1/100 value or smaller). If a storage elastic modulus GL and a loss elastic modulus GN have not the aforementioned temperature interval, a fixing temperature may become high and, as a result, energy saving at a fixing step may not be sufficiently reduced, in some cases.

<Process for Producing Toner for Electrophotography>

A process for producing a toner for electrophotography of the invention explained above is not particularly limited, but a wet granulating method is particularly preferable. Examples of a wet granulating method include the known methods such as a melt suspension method, an emulsification aggregating method, and a dissolution suspension method and, since the invention is useful upon use of an emulsification aggregating method, an example of an emulsification aggregating method will be explained.

The emulsification aggregating method has an emulsification step of emulsifying a specified polyester resin already explained in an item of "binder resin" in the "toner for electrophotography" of the invention to form an emulsified particle (droplet), an aggregating step of forming an aggregate of the emulsified particle (droplet), and a fusing step of fusing the aggregates to thermally fuse it.

—Emulsifying Step—

In an emulsification step, an emulsified particle (droplet) of a crystalline polyester resin is formed by giving a shearing form to a solution obtained by mixing an aqueous medium, and a mixed solution (polymer solution) containing a polyester resin, the already described low-molecular compound having a naphthalene skeleton or a biphenyl skeleton, if necessary, a coloring agent. A low-molecular compound having a naphthalene skeleton or a biphenyl skeleton is melted and kneaded in a crystalline resin in advance, or dissolved and mixed with a crystalline resin using an organic solvent.

Thereupon, by decreasing a viscosity of a polymer solution by heating, or dissolving a polyester resin in an organic solvent, an emulsified particle can be formed. However, from a viewpoint of environmental pollution, it is better not to use an organic solvent, if possible. In addition, for stabilizing an emulsified particle or increasing a viscosity of an aqueous medium, a dispersant may be used. Hereinafter, a dispersion of such the emulsified particle is referred to as "resin particle dispersion".

Examples of a dispersant include water-soluble polymers such as polyvinyl alcohol, methylcellulose, ethylcellulose, hydroxyethylcellulose, carboxymethylcellulose, sodium polyacrylate, and sodium polymethacrylate, surfactants such as anionic surfactants such as sodium dodecylbenzenesulfonate, sodium octadecylsulfate, sodium oleate, sodium laurate, and potassium stearate, cationic surfactants such as laurylamine acetate, stearylamine acetate, and lauryltrimethylammonium chloride, amphoteric surfactants such as lauryldimethylamine oxide, nonionic surfactants such as polyoxyethylene alkyl ether, polyoxyethylene alkyl phenyl ether, and polyoxyethylene alkyl amine, and inorganic compounds such as tricalcium phosphate, aluminum hydroxide, calcium sulfate, calcium carbonate, and barium carbonate.

When an inorganic compound is used as a dispersant, a commercially available dispersant may be used as it is. However, for the purpose of obtaining a particle, a method of producing a particle of an inorganic compound in a dispersant may be adopted. An amount of a dispersant to be used is preferably in a range of 0.01 to 20 parts by mass relative to 100 parts by mass of a crystalline polyester resin.

When a crystalline polyester resin is copolymerized with dicarboxylic acid having a sulfonic acid group (i.e. a dicarboxylic acid-derived constitutional component having a sulfonic acid group is contained in an acid-derived constitutional component at a preferable amount), a dispersion stabilizing agent such as a surfactant may be decreased in an emulsification step. When an amount of a sulfonic acid group is increased, emulsification can be easily performed. However, there is a tendency that charging property, in particular, charging property under a high temperature and a high humidity of a toner may be deteriorated, it is preferable that a composition of as a small amount as possible content of a sulfonic acid group is designed as in the already mentioned crystalline polyester resin. When a crystalline polyester resin is used, it is also possible to form an emulsifying particle without using dicarboxylic acid having a sulfonic acid group.

Examples of an organic solvent include ethyl acetate and toluene, and an organic solvent is appropriately used by selection depending on a crystalline polyester resin.

An amount of an organic solvent to be used is preferably in a range of 50 to 1,000 parts by mass, more preferably in a range of 120 to 1,000 parts by mass relative to a total amount of a crystalline polyester resin and, if necessary, other monomer (hereinafter, collectively simply referred to as "polymer" in some cases) of 100 parts by mass. Before formation of this emulsified particle, a coloring agent may be mixed. A coloring agent to be used is as already described in an item of "coloring agent" of the toner for electrophotography of the invention.

When polyester having a reduced amount of a sulfone group is used, by bringing a pH at emulsification to an alkaline side, emulsification can be performed by decreasing a dispersant such as a surfactant.

Examples of an emulsifying machine used upon formation of an emulsified particle include a homogenizer, a homomixer, a cabtron, a cleamix, a pressure kneader, an extruder, and a media dispersing machine. A size of an emulsified particle (droplet) of a polyester resin is such that its average particle diameter (volume average particle diameter) is preferably in a range of 0.01 to 1 μm, more preferably in a range of 0.03 to 0.3 μm, further preferably 0.03 to 0.4 μm.

As a method of dispersing a coloring agent, an arbitrary method, for example, a general dispersing method such as a rotation shearing-type homogenizer, and a ball mill, a sand mill, and a dinomill having media can be used, being not limiting.

If necessary, a surfactant may be used to prepare a water dispersion of these coloring agents, or a dispersant may be used to prepare an organic solvent dispersion of these coloring agents. Hereinafter, such the dispersion of a coloring agent is referred to as "colored particle dispersion" in some cases. As a surfactant and a dispersant used in dispersing, the same dispersant as a dispersant which can be used when a crystalline polyester resin is dispersed can be used.

An addition amount of a coloring agent is preferably in a range of 1 to 20% by mass, more preferably in a range of 1 to 10% by mass, further preferably in a range of 2 to 10% by mass, particularly preferably in a range to 2 to 7% by mass, relative to a total amount of a polymer.

When a coloring agent is mixed in an emulsification step, mixing of a polymer and a coloring agent can be performed by mixing a coloring agent or a dispersion of a coloring agent in an organic solvent into a solution of a polymer in an organic solvent.

—Aggregating Step—

In an aggregating step, the resulting emulsified particles are heated at a temperature near a melting point of a crystalline polyester resin and lower than a melting point to aggregate the particles to form an aggregate. Formation of an aggregate of an emulsified particle was performed by rendering a pH of an emulsion acidic under stirring. The pH is preferably in a range of 2 to 6, more preferably in a range of 2.5 to 5, further preferably in a range of 2.5 to 4. Thereupon, it is effective to use an aggregating agent.

As an aggregating agent, a surfactant having polarity reverse to that of a surfactant used in a dispersant, and an inorganic metal salt, additionally, a di- or more-valent metal complex can be suitably used. In particular, when a metal complex is used, since an amount of a surfactant to be used can be decreased, and charging property is improved, it is particularly preferable.

Examples of an inorganic metal salt include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide and calcium polysufide. Among them, in particular, an aluminum slat and a polymer thereof are suitable. In order to obtain a sharper particle size distribution, when a valent number of an inorganic salt is tetravalent rather than trivalent, trivalent rather than divalent, and divalent rather than monovalent, and even at the same valent number, a polymerization type inorganic metal salt polymer is more suitable.

—Fusing Step—

In a fusing step, by rendering a pH of a suspension of an aggregate in a range of 3 to 10 under the same stirring as that of an aggregating step, progression of an aggregation is stopped and, by performing heating at a temperature not lower than a melting point of a crystalline polyester resin, aggregates are fused.

When a heating temperature is not lower than a melting point of the polyester resin, there is no problem. A time for heating may be to such an extent that fusing is sufficiently performed, and about 0.5 to 10 hours is better.

A fused particle obtained by fusion can be made to be a particle of a toner via a solid liquid separation step such as filtration, if necessary, a washing step and a drying step. In this case, in order to maintain sufficient charging property and reliance as a toner, it is preferable to sufficiently wash in a washing step.

In a drying step, an arbitrary method such as a conventional vibration-type flowing drying method, a spray drying method, a lyophilizing method, and a flush jet method can be adopted. In a toner particle, it is desirable that water content after drying is adjusted to 1.0% by mass or less, preferably 0.5% by mass or less.

In the case where polyester containing a double bond is used as a copolymerization component, when the polyester resin is heated to not lower than a melting point in an emulsification step, an aggregating step and a fusing step, or after completion of each step, a crosslinking reaction may be preformed by separately heating the resin. When a crosslinking reaction is performed, for example, an unsaturated crystalline polyester resin in which a double bond component is copolymerized is used as a binder resin, and a radical reaction is caused in this resin to introduce a crosslinked structure. Thereupon, the following polymerization initiator may be used.

Examples of a polymerization initiator include t-butyl peroxy-2-ethylhexanoate, cumyl perpivalate, t-butyl peroxylaurate, benzoyl peroxide, lauroyl peroxide, octanoyl peroxide, di-t-butyl peroxide, t-butylcumyl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(t-butylperoxy)hexane, 2,5-dimethyl-2,5-di(benzoylperoxy)hexane, di-t-butyldiperoxyisophthalate, 2,2-bis(4,4-di-t-butylperoxycyclohexyl)propane, di-t-butylperoxy-α-methyl succinate, di-t-butylperoxydimethylglutarate, di-t-butyl peroxyhexahydroterephthalate, di-t-butyl peroxyazelate, 2,5-dimethyl-2,5-di(t-butylperoxy)hexane, diethylene glycol-bis(t-butylperoxycarbonate), di-t-butyl peroxytrimethyladipate, tris(t-butylperoxy)triazine, vinyltris(t-butylperoxy)silane, 2,2'-azobis(2-methylpropionamidine dihydrochloride), 2,2'-azobis[N-(2-carboxyethyl)-2-methylpropionamidine], and 4,4'-azobis(4-cyanovaleric acid).

These polymerization initiators may be used alone, or two or more kinds may be used jointly An amount and a kind of a polymerization initiator are selected depending on an amount of an unsaturated site in a polymer, and a kind and an amount of a coloring agent which is present jointly.

A polymerization initiator may be mixed into a polymer in advance before an emulsification step, or may be taken into an aggregate mass in an aggregating step. Further, a polymerization initiator may be introduced at a fusion step, or after a fusion step. When introduced at an aggregating step, a fusion step, or after a fusion step, a solution in which a polymerization initiator is dissolved or emulsified is added to particle dispersion (resin particle dispersion etc.). For the purpose of controlling a polymerization step, the known crosslinking agent, chain transfer agent, and polymerization inhibitor may be added to these polymerization initiators.

According to the process for producing a toner for electrophotography explained above, a toner for electrophotography excellent in toner blocking resistance, retainability of an image, and low fixability can be provided.

In addition, when a crystalline polyester resin has a crosslinking structure due to an unsaturated bond, in particular, a toner for electrophotography which has better offset resistance, has a wide fixing latitude, and can satisfy prevention of excess permeation of a toner into a recording material such as a paper can be obtained. Further, by rendering a particle shape of a toner spherical, a transferring efficiency can be improved.

[2] Developer for Electrophotography

The developer for electrophotography of the invention contains a toner for electrophotography and a carrier, and the toner for electrophotography is a toner for elctrophotography of the invention.

A carrier which can be used in a developer for electrophotography of the invention being the aforementioned two-component developer is not particularly limited, but the known carrier can be used. Examples include a resin coating carrier having a resin-covering layer on a surface of a core material. Alternatively, a resin dispersion-type carrier in which an electrically conductive material dispersed in a matrix resin may be used.

Examples of a covering resin and matrix resin used in a carrier include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, straight silicone resin comprising an organosiloxane bond or a modified product thereof, a fluorine resin, a polyester, a polycarbonate, phenol resin, and an epoxy resin, being not limiting.

Examples of an electrically conductive material include a metal such as gold, silver and copper, titanium oxide, zinc oxide, barium sulfate, aluminum borate, potassium titanate, tin oxide and carbon black, being not limiting.

Examples of a core material of a carrier include a magnetic metal such as iron, nickel and cobalt, a magnetic oxide such as ferrite, and magnetite, and glass beads. For using a carrier in a magnetic brush, a magnetic material is preferable. A volume average particle diameter of a core material of a carrier is preferably in a range of 10 to 500 μm, more preferably in a range of 30 to 100 μm.

In order to cover a surface of a core material of a carrier of a resin, there is a method of covering a surface with a covering layer forming solution in which the covering resin and, if necessary, various additives are dissolved in a suitable solvent. A solvent is not particularly limited, but may be appropriately selected by considering a covering resin to be used, and coating suitability Examples of a specific resin covering method include an immersion method of immersing a core material of a carrier in a covering layer forming solution, a spray method of spraying a covering layer forming solution to a surface of a core material of a carrier, a fluidizing method of spraying a covering layer forming solution in the state where a core material of a carrier is floated by the flowing air, and a kneader coater method of mixing a core material of a carrier and a covering layer forming solution in a kneader coater, and removing a solvent.

A mixing ratio (mass ratio) of the toner for electrophotography of the invented and the carrier in the two-component developer is preferably in a range of toner: carrier=about 1:100 to 30:100, more preferably in a range of about 3:100 to 20:100.

[3] Image Forming Method

Then, the image forming method of the invention using a toner for electrophotography of the invention will be explained. The forming method is an image forming method comprising a latent image forming step of forming an electrostatic latent image on a surface of a latent image retaining body, a developing step of developing the electrostatic latent image with a developer to form a toner image, a transferring step of transferring the toner image formed on a surface of a latent image retaining body onto a material to be recorded to form a transferred image, and a fixing step of fixing the transferred image transferred onto a recording material, and the developer contains the toner for electrophotography of the invention.

The developer may be any aspect of one-component system and two-component system as described above. In the case of a one-component series, the toner for electrophotography of the invention is used as it is and, in the case of a two component system, a two-component developer of the invention obtained by mixing a toner for electrophotography of the invention and a carrier is used.

In the aforementioned each step, the known step can be utilized in an image forming method. As a latent image retaining body, for example, an electrophotographic photoreceptor and a dielectric recording body can be employed. In the case of an electrophotographic photoreceptor, a surface of the electrophotographic photoreceptor is uniformly electrified with a corotron charging equipment, or a contact charging equipment, and exposed to form an electrostatic latent image (latent image forming step). Then, this is contacted with or brought closed to a developing roll having a surface on which a developer layer is formed to attach a toner particle to an electrostatic latent image, to form a toner image on a surface of an electrophotographic photoreceptor (developing step). A formed toner image is transferred onto a surface of a recording material such as a paper utilizing a corotron charging equipment (transferring step). Further, the toner image transferred onto a surface of a recording material is thermally fixed with a fixing equipment to form a final toner image (fixing step). Upon thermal fixing with fixing equipment, in order to prevent offset, usually, releasing oil is supplied to a fixing member in the fixing equipment.

In the image forming method of the invention, further, a cleaning step is preferably included, cleaning treatment in the cleaning step is cleaning treatment of removing a toner remaining the photoreceptor surface after via the developing step and transferring step, and it is preferable that any of the following conditions (1) to (3) is satisfied.

(1) A thickness of an electrically conductive substrate of the photoreceptor is not less than 1.4 mm and not more than 2.2 mm.

(2) A cleaning means in cleaning treatment is retained by a supporting member, and has an elastic blade abutted against a surface of the photoreceptor at an abutting pressure of a linear pressure of not less than 20 g/cm and not more than 40 g/cm.

(3) An abutting angle of the elastic blade is not less than 9° and not more than 17°.

A surface layer of a photoreceptor is preferably an organic photoreceptor containing a fluorine-based resin particle.

In such the clean treatment, when a thickness of an electrically conductive substrate is not less than 1.4 mm and not more than 2.2 mm, and a linear pressure of an elastic blade is less than 20 g/cm or an abutting angle is less than 9°, a blade sound is not generated, but cleaning defect may be caused many times. On the other hand, when a linear pressure of an elastic blade is greater than 40 g/cm. or an abutting angle is greater than 17°, cleaning defect is not generated, but a blade sound may be caused many times, occasionally, blade torsion may be generated, and this may lead to damage of the elastic blade and the photoreceptor surface layer.

When a thickness of the electrically conductive substrate is less than 1.4 mm, there is no influence on cleanability, but a blade sound may easily be produced, and a defect may arise that a range realizing both of acquisition of better cleaning performance and suppression of a blade sound is narrowed. Further, when a thickness of the electrically conductive substrate is not less than 2.2 mm, a defect may become unacceptable, such as cost up of the electrical conductive substrate itself and reduction in workability accompanied with increase in a weight.

Further, cleanability is improved by inclusion of a fluorine-based resin particle in a photoreceptor surface layer and, when a fluorine-based resin particle is not contained, a tendency that a cleaning defect is easily generated is shown.

As a layer construction of a photoreceptor (undercoating layer, charge transporting layer, charge generating layer, surface layer etc.), the previously known construction can be adopted. As a fluorine-based resin, it is desirable to appropriately select one or two kinds among an ethylene tetrafluoride resin, an ethylene chloride trifluoride resin, a propylene hexafluoride resin, a vinyl fluoride resin, a vinylidene fluoride resin, an ethylene dichloride difluoride resin and a copolymer thereof. In particular, an ethylene tetrafluoride resin, and a vinylidene fluoride resin are preferable. Specific examples include trade name; fluon PTFE (manufactured by Asahi Glass Company), trade name; fluon ETFE (manufactured by Asahi Glass Company), trade name; Kleha KF polymer (manufactured by Kleha Kagaku), and trade name; rubron L2 (Daikin Industries, Ltd.).

In the cleaning means, in order to abut an elastic blade against a surface of a rotating photoreceptor, generally, as shown in FIG. 1, it is preferable that a flat plate-like elastic blade 1 having a constant thickness is retained by a support member 2, and a tip part of this elastic blade 1 is abutted against a surface of a rotating photoreceptor 3.

It is preferable that an abutting angle □ of an elastic blade 1 formed by a contact surface of an elastic blade 1 contacting with a photoreceptor 3, and a tangential line 5 of a photoreceptor 3 at the contact point 4 on a rotating directing size of a photoreceptor 3 is set to be 9° to 17° and, at the same time, an abutting force (linear pressure) f of an elastic blade against an organic photoreceptor is set to be 20 to 40 g/cm.

It is preferable that a cleaning equipment in an image forming apparatus relating to the image forming method of the invention is constructed so that an opening part of a case is provided with an elastic blade which is a cleaning blade, and has a structure in which a remaining toner removed from a surface of photoreceptor is accommodated in a case.

Besides, a construction of an image input equipment (latent image forming means), a developing equipment (developing means), a transferring equipment (transferring means), an charge-removing equipment, and a fixing equipment is not particularly limited, but all constructions which have been previously known in the electrophotgraphy field can be applied as they are.

Figure 2:
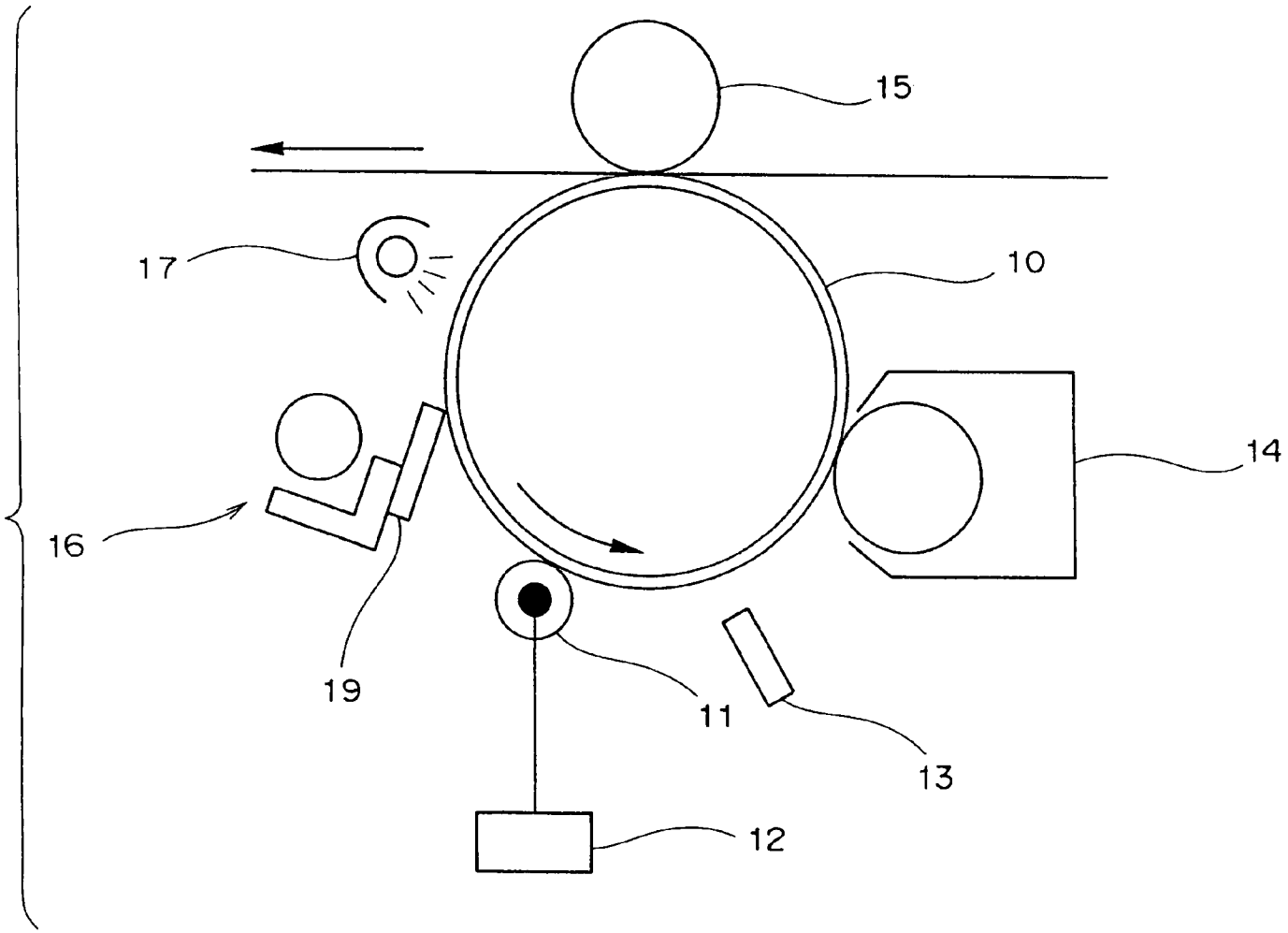
FIG. 2 is a schematic construction view showing an example of an image forming apparatus which can be applied to the image forming method of the invention.

Using an electrophotography apparatus of FIG. 2, the image forming method of the invention will be explained. A surface of an electrophotographic photoreceptor 10 is uniformly charged with a charging equipment 11 of a charging means and, thereafter, a latent image is formed with an image input equipment (latent image forming means) 13 (latent image forming step). A latent image formed on a surface of an electrophotographic photoreceptor 10 is developed with the toner for electrophotography of the invention built in a developing equipment (developing means) 14 to form a toner image (developing step). A toner image formed on a surface of an electrophotographic photoreceptor 10 is transferred onto a surface of a material to be transferred penetrated between an electrophotographic photoreceptor 10 and a transferring equipment (transferring means) 15 opposite thereto (transferring step), and is fixed by heat and/or pressure of a fixing equipment (not shown). On the other hand, a toner remaining on a surface of an elctrophotographic photoreceptor 10 after transference is removed with a cleaning equipment (cleaning means) 16 equipped with a cleaning blade 19 (cleaning step). And, before progresses to a next image forming cycle, a remaining potential on a surface of an electrophotographic photoreceptor 10 is removed with an electricity-removing equipment 17.

As a material for a cleaning blade, a urethane rubber, a silicone rubber, a fluorine rubber, a chloroprene rubber, and a butadiene rubber can be used. Among them, since abrasion resistance is excellent, it is preferable to use a polyurethane elastic body.

As a polyurethane elastic body, polyurethane which is generally synthesized by an addition reaction of isocyanate, and polyol and various hydrogen-containing compounds is used, and this is prepared by preparing a urethane prepolymer using a polyether-based polyol such as polypropylene glycol, and polytetramethylene glycol, or a polyester-based polyol such as an adipate-based polyol, a polycaprolactam-based polyol, and a polycarbonate-based polyol as a polyol component, and using aromatic polyisocyanate such as tolylene diisocyanate, 4,4'-diphenylmethane diisocyanate, polymethylene polyphenyl polyisocyanate, and toluidine diisocyanate, or aliphatic polyisocyanate such as hexamethylene diisocyanate, isophorone diisocyanate, xylylene diisocyanate, and dicyclohexylmethane diisocyanate as a polyisocyanate component, adding a curing agent to this, which is poured in a prescribed mold, and crosslinking-curing and aging it at a normal temperature.

As a curing agent, usually, a divalent alcohol such as 1,4-butanediol, and a tri-or more-valent polyvalent alcohol such as trimethylolpropane, and pentaerythritol are used jointly. Physical properties of a cleaning blade such as a hardness (JISA scale) of 50 to 90, Young modulus (kg/cm$^2$) of 40 to 90, a 100% modulus (kg/cm$^2$) of 20 to 65, a 300% modulus (kg/cm$^2$) of 70 to 150, a tensile strength (kg/cm$^2$) of 240 to 500, elongation (%) of 290 to 500, a repulsion elasticity (%) of 30 to 70, a tearing strength (kg/cm$^2$) of 25 to 75, and permanent elongation (%) of 4.0 or less can be used.

In the toner of electrophotography of the invention, when there is a crosslinked structure in a binder resin, due to its effect, releasability is excellent, an amount of releasing oil at a fixing member to be used may be decreased, or fixing may be performed without using the releasing oil.

From a viewpoint that attachment of oil to a material to be transferred and an image after fixing is eliminated, it is preferable not to use releasing oil. However, when an amount of a releasing oil to be supplied is 0 mg/cm$^2$, since upon contact of a fixing member and a recording material such as a paper at fixing, an abrasion amount of a fixing member may be increased, and durability of a fixing member may be decreased in some cases, it is preferable to supply a minor amount of a releasing oil to a fixing member in a range of an amount of a releasing oil to be used of $8.0\times10^{-3}$ mg/cm$^2$ or less, if necessary.

When an amount of a releasing oil to be supplied exceeds $8.0\times10^{-3}$ mg/cm$^2$, image quality may be reduced due to a releasing oil attached to an image surface after fixing and, in particular, in OHP, wherein transmitting light such is utilized, such the phenomenon may appear remarkably in some cases. In addition, attachment of releasing oil to a recording material becomes remarkable, and tackiness is generated in some cases. Further, as an amount of a releasing oil to be supplied is increased, a volume of a tank for storing releasing oil must be increased, and this becomes a cause leading to enlargement of a fixing apparatus itself.

Releasing oil is not particularly limited, but examples include liquid releasing oil such as a dimethylsilicone oil, a fluorine oil, a fluorosilicone oil, and a modified oil such as an amino-modified silicone oil. Inter alia, from a viewpoint that oil is adsorbed on a surface of a fixing member, and a uniform releasing oil layer can be formed, a modified oil such as an amino-modified silicone oil is excellent in wettability to a fixing member. In addition, from a viewpoint that a uniform releasing oily layer can be formed, fluorine oil, and fluorosilicone oil are preferable.

Since use of a fluorine oil or a fluorosilicone oil as a releasing oil can not reduce an amount of an releasing oil itself to be supplied in the previous image forming method not using the toner for electrophotography of the invention, this is not practical in cost. However, when the toner for electrophotography of the invention is used, since an amount of a releasing oil to be supplied can be dramatically decreased, there is no practical problem also in cost.

A method of supplying a releasing oil to a surface of a roller or a belt which is a fixing member used for heat pressing is not particularly limited, but examples include a pad manner using a pad impregnated with a liquid releasing oil, a web manner, a roller manner, and a non-contact shower manner (spray method). Inter alia, a web manner and a roller manner are preferable. In these manners, they are advantageous in that the releasing oil can be uniformly supplied, and a supply amount is easily controlled. In order to supply releasing oil uniformly to a whole fixing member by a shower manner, it is necessary to use a blade separately.

A supply amount of a releasing oil can be measured as follows: that is, when a normal paper (a representative of which is a copying sheet manufactured by Fuji Xerox Co., Ltd., trade name: J paper) which is used in a general copying machine is passed through a fixing member having a surface to which a releasing oil has been supplied, a releasing oil is attached to a surface of a normal paper. This attached releasing oil is extracted using a Soxhlet's extractor. Herein, as a solvent, hexane is used. An amount of releasing oil attached to a normal paper can be quantitated by quantitation with an atomic absorption analyzing apparatus. This amount is defined as an amount of a releasing oil to be supplied to a fixing member.

Examples of a material to be recorded (recording material) onto which a toner image is transferred using a normal paper and an OHP sheet used in an electrophotgraphy manner copying machine or printer. In order to further improve smoothness of an image surface after fixing, it is preferable that a surface of a material to be recorded is as flat as possible and, for example, a coated paper obtained by coating a surface of a normal paper with a resin, and an art paper for printing can be suitably used.

According to the image forming method using the toner for electrophotography of the invention, since aggregation of a toner is not caused, an image having excellent image quality can be formed, low temperature fixing is possible, and retainability of a formed image is excellent. Further, when a binder resin has a crosslinked structure, since there is little attachment of the releasing oil to a material to be recorded, by forming an image using a material to be recorded having a back with pressure-sensitive adhering property imparted thereto, a seal or a sticker on which a high quality and high concentration image is formed can be prepared.

EXAMPLE

The present invention will be explained by way of Examples, but the invention is not limited to these Examples.

Example 1

Production of Toner

—Synthesis of Crystalline Polyester Resin (1)—

400 g (1.98 mole) of sebacic acid, 277.5 g (2.47 mole) of 1,6-hexanediol, 96.1 g (0.49 mole) of dimethyl terephthalate, and 0.3 g of dibutyltin oxide are placed into a 5 L flask, they are reacted at 180° C. for 5 hours by mechanical stirring under the nitrogen atmosphere, and a condensation reaction is performed at 220° C. under reduced pressure.

During the reaction, a polymer is sampled, a molecular weight is measured by gel permeation chromatography (GPC), and a reaction is stopped when a weight average molecular weight Mw becomes 21,000, and a number average molecular weight Mn becomes 9,000.

A melting point (Tm) of a resulting crystalline polyester resin (1) is measured using a differential scanning calorimeter (DSC) by the aforementioned method, and a temperature of peak top is 68.6° C.

—Synthesis of Crystalline Polyester Resin (2)—

500 g (2.47 mole) of sebacic acid, 365.2 g (3.09 mole) of 1,6-hexanediol, 151 g (0.618 mole) of dimethyl 2,6-naphthalnedicarboxylate, and 0.38 g of dibutyltin oxide are placed in a 5 L flask, they are reacted at 180° C. for 5 hours by mechanical stirring under the nitrogen atmosphere and, subsequently, a condensation reaction is performed at 220° C. under reduced pressure.

During the reaction, a polymer is sampled, a molecular weight is measured by gel permeation chromatography (GPC), and a reaction is stopped when a weight average molecular weight Mw becomes 23,000, and a number average molecular weight Mw becomes 11,100.

A melting point (Tm) of the resulting crystalline polyester resin (2) is measured using a differential scanning calorimeter (DSC) by the aforementioned measuring method, and a temperature of a peak top is 67.5° C.

—Synthesis of Crystalline Polyester Resin (3)—

1,436 g (7.1 mole) of sebacic acid, 934.8 g(7.91 mole) of 1,6-hexanediol, 213.3 g (0.79 mole) of dimethyl biphenylcarboxylate, and 0.98 g of dibutyltin oxide are placed in a 5 L flask, they are reacted at 180° C. for 5 hours by mechanical stirring under the nitrogen atmosphere and, subsequently, a condensation reaction is performed at 220° C. under reduced pressure.

During the reaction, a polymer is sampled, a molecular weight is measured by gel permeation chromatography (GPC), and a reaction is stopped when a weight average molecular weight Mw becomes 26,000, and a number average molecular weight Mn becomes 12,000.

A melting point (Tm) of the resulting crystalline polyester resin (3) is measured using a differential scanning calorimeter (DSC) by the aforementioned measuring method, and a temperature of a peak top is 70.5° C.

—Preparation of Crystalline Polyester Resin Compound (1)—

2.4 g of dimethyl 4,4'-biphenyldicarboxylate is added to 80 g of a crystalline polyester resin (1), the materials are stirred and mixed at 160° C. for 30 miniutes to obtain a crystalline polyester resin compound (1).

—Preparation of Crystalline Polyester Resin Latex (1)—

40 g of the resulting crystalline polyester resin compound (1) is added to 360 g of ion exchanged water, this is heated to 90° C., and stirred at 8,000 rpm using an emulsifying machine (Ultra Turrax T-50 manufactured by IKA) while 8 g of a 10 mass % dodecylbenzenesulfonic acid aqueous solution is added, to prepare a crystalline polyester resin latex (1) having a volume average particle diameter of 350 nm.

—Preparation of Crystalline Polyester Resin Compound (2)—

2.4 g of dimethyl 2,6-naphthalenedicarboxylate is added to 80 g of a crystalline polyester resin (1), and the materials are stirred and mixed at 160° C. for 30 minutes to obtain a crystalline polyester resin compound (2).

—Preparation of Crystalline Polyester Resin Latex (2)—

40 g of the resulting crystalline polyester resin compound (2) is added to 360 g of ion exchanged water, and this is heated to 90° C., and stirred at 8,000 rpm using an emulsifying machine (Ultra Turrax T-50, manufactured by IKA) while 8 g of a 10 mass % dodecylbenzene sulfonic acid aqueous solution is added, to prepare a crystalline polyester resin latex (2) having an average particle diameter of 300 nm.

—Preparation of Crystalline Polyester Resin Compound (3)—

4.8 g of dimethyl 2,6-naphthalenedicarboxylate is added to 80 g of a crystalline polyester resin (1), and the materials are stirred and mixed at 160° C. for 30 minutes to obtain a crystalline polyester resin compound (3).

—Preparation of Crystalline Polyester Resin Latex (3)—

40 g of the resulting crystalline polyester resin compound (3) is added to 360 g of ion exchange water, and this is heated to 90° C., and stirred at 8,000 rpm using an emulsifying machine (Ultra Turrax T-50 manufactured by IKA) while 8 g of a 10 mass % dodecylbenzene suyfonic acid aqueous solution is added, to prepare a crystalline polyester resin latex (3) having a volume average particle diameter of 400 nm.

—Preparation of Crystalline Polyester Resin Compound (4)—

2.4 g of dimethyl 2,6-naphthalenedicarboxylate is added to 80 g of a crystalline polyester resin (2), and the materials are stirred and mixed at 160° C. for 30 minutes to obtain a crystalline polyester resin compound (4).

—Preparation of Crystalline Polyester Resin Latex (4)—

40 g of the resulting crystalline polyester resin compound (4) is added to 360 g of ion exchanged water, and this is heated to 90° C., and stirred at 8,000 rpm using an emulsifying machine (Ultra Turrax T50 manufactured by IKA) while 8 g of a 10 mass % dodecylbenzene sulfonic acid aqueous solution is added, to prepare a crystalline polyester resin latex (4) having a volume average particle diameter of 450 nm.

—Preparation of Crystalline Polyester Resin Compound (5)—

4.8 g of dimethyl 2,6-naphthalenedicarboxylate is added to 80 g of a crystalline polyester resin (2), and the materials are stirred and mixed at 160° C. for 30 minutes to obtain a crystalline polyester resin compound (5).

—Preparation of Crystalline Polyester Resin Latex (5)—

40 g of the resulting crystalline polyester resin compound (5) is added to 360 g of ion exchanged water, and this is heated to 90° C., and stirred at 8,000 rpm using an emulsifying machine (Ultra Turrax T50 manufactured by IKA) while 8 g of a 10 mass % dodecylbenzene sulfonic acid aqueous solution is added, to prepare a crystalline polyester resin latex (5) having a volume average particle diameter of 280 nm.

—Preparation of Crystalline Polyester Resin Compound (6)—

2.4 g of dimethyl 2,6-naphthalenedicarboxylate is added to 80 g of a crystalline polyester resin (3), and the materials are stirred and mixed at 160° C. for 30 minutes to obtain a crystalline polyester resin compound (6).

—Preparation of Crystalline Polyester Resin Latex (6)—

40 g of the resulting crystalline polyester resin compound (6) is added to 360 g of ion exchanged water, and this is heated to 90° C., and stirred at 8,000 rpm using an emulsifying machine (Ultra Turrax T50 manufactured by IKA) while 8 g of a 10 mass % dodecylbenzene sulfonic acid aqueous solution is added, to prepare a crystalline polyester resin latex (6) having a volume average particle diameter of 300 nm.

—Preparation of Crystalline Polyester Resin Compound (7)—

4.8 g of dimethyl 2,6-naphthalenedicarboxylate is added to 80 g of a crystalline polyester resin (3), and the materials are stirred and mixed at 160° C. for 30 minutes to obtain a crystalline polyester resin compound (7).

—Preparation of Crystalline Polyester Resin Latex (7)—

40 g of the resulting crystalline polyester resin compound (7) is added to 360 g of ion exchanged water, and this is heated to 90° C., and stirred at 8,000 rpm using an emulsifying machine (Ultra Turrax T50 manufactured by IKA) while 8 g of a 10 mass % dodecylbenzene sulfonic acid aqueous solution is added, to prepare a crystalline polyester resin latex (7) having a volume average particle diameter of 360 nm.

—Preparation of Pigment Dispersion B-1—

The following composition is mixed and dissolved, and dispersed by a homogenizer (Ultra Turrax T50 manufactured by IKA) and ultrasound irradiation to obtain a blue pigment dispersion B-1 having a volume average particle diameter.

| | |
|---|---|
| Cyan pigment (C.I.Pigment Blue 15:3, copper phthalocyanine manufacture by Dinippon Ink and Chemicals, Incorporated) | 50 g |
| Anionic surfactant (Neogen SC) | 5 g |
| Ion exchanged water | 200 g |

—Preparation of Releasing Agent Dispersion C-1—

The following composition is mixed, heated to 97° C., and dispersed with a homogenizer (Ultra Turrax T50, manufactured by IKA). Thereafter, dispersing treatment is performed with a Golin homogenizer (manufactured by Meiwashowji), and treatment is performed twenty times under condition of 105° C. and 550 kg/cm$^2$ to obtain a releasing agent dispersion C-1 having a volume average particle diameter of 190 nm.

| | |
|---|---|
| Wax (WEP-2, manufactured by Nippon Oil & Fats Co., Ltd.) | 25 g |
| Anionic surfactant (Neogen SC) | 5 g |
| Ion exchanged water | 200 g |

—Preparation of Toner for Electrophotography (1)—

The following composition is mixed and dispersed with a homogenizer (Ultra Turrax T50, manufactured by IKA) in a round-bottom stainless flask, and this is heated to 48° C. while a content in a flask is stirred in a heating oil bath, and retained at 48° C. for 30 minutes.

| | |
|---|---|
| Crystalline resin latex (1) | 600 g |
| Pigment dispersion B-1 | 25 g |
| Releasing agent dispersion C-1 | 100 g |
| 10 mass % polyaluminum chloride aqueous solution (manufactured by Asada Chemical Co.) | 1.5 g |

Thereafter, the resulting content is observed with a light microscope, and it is confirmed that an aggregating particle having a particle diameter of about 4.5 μm is produced. Further, a temperature of the heating oil bath is raised, and retained at 60° C. for 1 hour. The resulting content is observed with a light microscope and it is confirmed that an aggregated particle having a particle diameter of about 6.5 μm is produced. A pH is adjusted to 5 with an aqueous sodium hydroxide solution and, thereafter, the temperature is raised to 75° C. by a heating oil bath, this is cooled, filtered, sufficiently washed with ion exchanged water, and dried to obtain an aggregated toner.

When a particle diameter of this toner for electrophotography (1) is measured with a coulter counter, a volume average particle diameter is 6.4 μm. In addition, volume GSD which is an index of a volume particle size distribution is 1.28.

Herein, volume GSD can be obtained by obtaining a volume average particle diameter D84 at 84% and volume average particle diameter D16 at 16%, respectively, in a volume average particle diameter distribution curve using a coulter counter, and substituting each value in $(D84/D16)^{1/2}$. The volume average particle diameter indicates a volume average particle diameter D50 at 50%.

(Assessment of Toner)

—Charging Amount of Toner—

1.5 g of a toner for electrophotography (1), and 30 g of a carrier (carrier for DC400, manufactured by Fuji Xerox Co., Ltd.) are allowed to sand overnight under the low temperature and low humidity environment (temperature: 10° C., humidity: 15% RH) and under the high temperature and high humidity environment (environmental chamber of temperature : 28° C., humidity: 85% RH), respectively. Thereafter, each is mixed and stirred for 60 minutes with a Turbula stirring apparatus, and a charge amount is measured with a blow off tribo measuring apparatus (manufactured by Toshiba)

—Assessment of Low Temperature Fixability—

Using the resulting toner for electrophotography (1), image formation is performed on a surface of a recording paper with an A-Color full color copying machine (manufactured by Fuji Xerox Co., Ltd.) which is modified from a fixing machine, and low temperature fixability of the toner for electrophotography is assessed. In assessment, a temperature is changed every 10° C. from 80° C. to 200° C., a fixed image is prepared at each fixing temperature, an image surface of the resulting each fixed image is valley-folded, a pealing degree of an image at a folding part is observed, a lowest fixing temperature as MTF (° C.) at which an image is hardly peeled is measured, and low temperature fixability is assessed. Results are shown in Table 1. When the fixing temperature is 130° C. or lower, it can be said that low temperature fixability is excellent.

Test conditions of the low temperature fixabiilty are shown below.

[Test Conditions]

Toner image: solid image (40 mm×50 mm)

Toner amount: 0.9 mg/cm$^2$

Recording paper: paper for color copy (J paper, manufactured by Fuji Xerox Co.,) Ltd.

Conveying rate: 160 mm/sec

Silicone oil coating amount: 1.6×10$^{-3}$ mg/cm$^2$

—Assessment of Toner Durability (Change of Shape)—

Image surfaces of two recording papers on which a fixed image is formed at a lowest fixing temperature (MFT(° C.)) are overlaid, and allowed to stand for 7 days in the state where a load 100 g/cm$^2$ is applied under the environment of a temperature of 60° C. and a humidity of 85%. The overlaid image is peeled, and whether fusion of an image between recording papers, or transference at a non-image part is present or is not observed with naked eyes, and this is assessed by the following assessment criteria.

G1: There is little crushed toner or little toner which was aggregated to 30 micron or larger in a developing equipment.

G2: There are a few crushed toners, or a few toners which are aggregated to 30 micron or larger in a developing equipment, and there in no practical problem.

G3: Although some deformation is observed, there is no practical problem.

G4: Great deformation is observed, and practical use is impossible.

Results are shown in Table 1.

Example 2

Preparation of Toner for Electrophotograhy (2)

According to the same manner as that of the toner for electrophotography (1) of Example 1 except that crystalline polyester resin latex (2) is used, a toner for electrophotography (2) is prepared. When a particle diameter of this toner particle for elctrophotography (2) is measured and, volume GSD which is an index of a volume particle size distribution is 1.25.

(Assessment of Toner)

According to the same manner as that of Example 1 except that the toner for electrophotography (2) is used in place of the toner for electrophotography (1) in assessment of a toner of Example 1, assessment is performed. Results are shown in Table 1.

Example 3

Preparation of Toner for Electrophotography (3)

According to the same manner as that of the toner for electrophotography (1) of Example 1 except that crystalline polyester resin latex (3) is used, a toner for electrophotography (3) is prepared. When a particle diameter of this toner particle for elctrophotography (3) is measured with a coulter counter, a volume average particle diameter is 6.2 μm. And, volume GSD which is an index of a volume particle size distribution is 1.30.

(Assessment of Toner)

According to the same manner as that of Example 1 except that the toner for electrophotography (3) is used in place of the toner for electrophotography (1) in assessment of a toner of Example 1, assessment is performed. Results are shown in Table 1.

Example 4

Preparation of Toner for Electrophotography (4)

According to the same manner as that of the toner for electrophotography (1) of Example 1 except that crystalline polyester resin latex (4) is used, a toner for electrophotography (4) is prepared. When a particle diameter of this toner particle for elctrophotography (4) is measured with a coulter counter, a volume average particle diameter is 6.6 μm. And, volume GSD which is an index of a volume particle size distribution is 1.25.

(Assessment of Toner)

According to the same manner as that of Example 1 except that the toner for electrophotography (4) is used in place of the toner for electrophotography (1) in assessment of a toner of Example 1, assessment is performed. Results are shown in Table 1.

Example 5

Preparation of Toner for Electrophotography (5)

According to the same manner as that of the toner for electrophotography (1) of Example 1 except that crystalline polyester resin latex (5) is used, a toner for electrophotography (5) is prepared. When a particle diameter of this toner particle for elctrophotography (5) is measured with a coulter counter, a volume average particle diameter is 6.9 μm. And, volume GSD which is an index of a volume particle size distribution is 1.22.

(Assessment of Toner)

According to the same manner as that of Example 1 except that the toner for electrophotography (5) is used in place of the toner for electrophotography (1) in assessment of a toner of Example 1, assessment is performed. Results are shown in Table 1.

Example 6

Preparation of Toner for Electrophotography (6)

According to the same manner as that of the toner for electrophotography (1) of Example 1 except that crystalline polyester resin latex (6) is used, a toner for electrophotography (6) is prepared. When a particle diameter of this toner particle for elctrophotography (6) is measured with a coulter counter, a volume average particle diameter is 6.7 μm. And, volume GSD which is an index of a volume particle size distribution is 1.25.

(Assessment of Toner)

According to the same manner as that of Example 1 except that the toner for electrophotography (6) is used in place of the toner for electrophotography (1) in assessment of a toner of Example 1, assessment is performed. Results are shown in Table 1.

Example 7

Preparation of Toner for Electrophotography (7)

According to the same manner as that of the toner for electrophotography (1) of Example 1 except that crystalline polyester resin latex (7) is used, a toner for electrophotography (7) is prepared. When a particle diameter of this toner particle for elctrophotography (7) is measured with a coulter counter, a volume average particle diameter is 6.4 μm. And, volume GSD which is an index of a volume particle size distribution is 1.28.

(Assessment of Toner)

According to the same manner as that of Example 1 except that the toner for electrophotography (7) is used in place of the toner for electrophotography (1) in assessment of a toner of Example 1, assessment is performed. Results are shown in Table 1.

Example 8

Synthesis of crystalline polyester resin (4)

1,600 g (7.91 mole) of sebacic acid, 934.8 g (7.91 mole) of 1,6-hexanediol, and 0.98 g of dibutyltin oxide are placed into a 5 L flask, they are reacted at 180° C. for 5 hours by mechanical stirring under the nitrogen atmosphere and, subsequently, a condensation reaction is performed at 220° C. under reduced pressure.

During the reaction, a molecular weight is measured by gel permeation chromatography (GPC), and a reaction is stopped when a weight average molecular weight Mw becomes 26,000, and a number average molecular weight Mn becomes 12,000.

A melting point (Tm) of the resulting crystalline polyester resin (4) is measured using a differential scanning calorimeter (DSC) by the aforementioned measuring method, and a temperature of a peak top is 70.5° C.

4.8 g of dimethyl 2,6-naphthalenedicarboxylate is added to 80 g of a crystalline polyester resin (4), and the materials are stirred and mixed at 160° C. for 30 minutes to obtain a crystalline polyester resin compound (8).

40 g of the resulting crystalline polyester resin compound (8) is added to 360 g of ion exchanged water, and this is heated to 90° C., and stirred at 8,000 rpm using an emulsifying machine (Ultra Turrax T-50, manufactured by IKA) to obtain a particle (8) having a particle diameter of about 0.3 μm.

<Preparation of Toner for Electrophotography (8)>

According to the same manner as that of the toner for electrophotography (1) of Example 1 except that crystalline polyester resin latex (8) is used, a toner for electrophotography (8) is prepared. When a particle diameter of this toner particle for elctrophotography (8) is measured with a coulter counter, a volume average particle diameter is 6.8 μm. And, volume GSD which is an index of a volume particle size distribution is 1.29.

(Assessment of Toner)

According to the same manner as that of Example 1 except that the toner for electrophotography (8) is used in place of the toner for electrophotography (1) in assessment of a toner of Example 1, assessment is performed. Results are shown in Table 1.

Example 9

Preparation of Crystalline Polyester Resin Compound (9)

10 g of dimethyl 2,6-naphthalenedicarboxylate is added to 80 g of a crystalline polyester resin (2), and the materials are stirred and mixed at 160° C. for 30 minutes.

—Preparation of Crystalline Polyester Resin Latex (7)—

40 g of the resulting crystalline polyester resin compound (9) is added to 360 g of ion exchanged water, and this is heated to 90° C., and stirred at 8,000 rpm using an emulsifying machine (Ultra Turrax T-50, manufactured by IKA) while 8 g of a 10 mass % dodecylbenzenesulfonic acid aqueous solution is added, to prepare a crystalline polyester resin latex (9) having a volume average particle diameter of 300 nm.

<Preparation of Toner for Electrophotography (9)>

According to the same manner as that of the toner for electrophotography (1) of Example 1 except that crystalline polyester resin latex (9) is used, a toner for electrophotography (9) is prepared. When a particle diameter of this toner particle for elctrophotography (9) is measured with a coulter counter, a volume average particle diameter was 6.5 μm. And, volume GSD which is an index of a volume particle size distribution is 1.28.

(Assessment of Toner)

According to the same manner as that of Example 1 except that the toner for electrophotography (9) is used in place of the toner for electrophotography (1) in assessment of a toner of Example 1, assessment is performed. Results are shown in Table 1.

Example 10

Preparation of Crystalline Polyester Resin Compound (10)

10 g of dimethyl 4,4'-biphenyldicarboxylate is added to 80 g of a crystalline polyester resin (2), and the materials are stirred and mixed at 160° C. for 30 minutes.

—Preparation of Crystalline Polyester Resin Latex (10)—

40 g of the resulting crystalline polyester resin compound (10) is added to 360 g of ion exchanged water, and this is heated to 90° C., and stirred at 8,000 rpm using an emulsifying machine (Ultra Turrax T-50, manufactured by IKA) while 8 g of a 10 mass % dodecylbenzenesulfonic acid aqueous solution is added, to prepare a crystalline polyester resin latex (10) having a volume average particle diameter of 300 nm.

<Preparation of Toner for Electrophotography (10)>

According to the same manner as that of the toner for electrophotography (1) of Example 1 except that crystalline polyester resin latex (10) is used, a toner for electrophotography (10) is prepared. When a particle diameter of this toner particle for elctrophotography (10) is measured with a coulter counter, a volume average particle diameter is 6.7 μm. And, volume GSD which is an index of a volume particle size distribution is 1.27.

(Assessment of Toner)

According to the same manner as that of Example 1 except that the toner for electrophotography (10) is used in place of the toner for electrophotography (1) in assessment of a toner of Example 1, assessment is performed. Results are shown in Table 1.

Comparative Example 1

According to the same manner as that of the toner for electrophotography (1) of Example 1 except that dimethyl biphenyldicarboxylate (low-molecular compound) is not added, a toner for electrophotography (11) is prepared. When a particle diameter of the toner particle for electrophotography (11) is measured with a coulter counter, a volume average particle diameter is 6.5 μm. And, volume DSG which is an index of a volume particle size distribution is 1.26.

Comparative Example 2

According to the same manner as that of the toner for electrophotography (1) of Example 1 except that 2.4 g of 12-hydroxystearic acid is added in place of dimethyl biphenyldicarboxylate (low molecular compound), a toner for electrophotography (12) is prepared. When a particle diameter of this toner particle for electrophotography (12) is measured with a coulter counter, a volume average particle diameter is 6.4 μm. And, volume GSD which is an index of a volume particle size distribution is 1.25.

Also regarding Comparative Example 1 and Comparative Example 2, assessment is performed as in Example 1. Results are shown in Table 1.

| | Example 1 | Example 2 | Example 3 | Example 4 | Example 5 | Example 6 |
|---|---|---|---|---|---|---|
| Crystalline polyester resin | (1) | (1) | (1) | (2) | (2) | (3) |
| Low-molecular compound | Dimethyl 4,4'-diphenyl-dicarboxylate | Dimethyl 2,6-naphthalene-dicarboxylate | Dimethyl 2,6-naphthalene-dicarboxylate | Dimethyl 2,6-naphthalene-dicarboxylate | Dimethyl 2,6-naphthalene-dicarboxylate | Dimethyl 2,6-naphthalene-dicarboxylate |
| Addition amount (g) to 80 g of crystalline resin | 2.4 | 2.4 | 4.8 | 2.4 | 4.8 | 2.4 |
| Crystalline resin latex | Latex (1) | Latex (2) | Latex (3) | Latex (4) | Latex (5) | Latex (6) |
| Toner | Toner (1) | Toner (2) | Toner (3) | Toner (4) | Toner (5) | Toner (6) |
| Charge amount (under high temperature & high humidity) | 23 | 25 | 21 | 24 | 20 | 27 |
| Charge amount (under low temperature & low humidity) | 34 | 39 | 35 | 38 | 37 | 43 |
| MFT (° C.) | 100 | 100 | 100 | 100 | 100 | 100 |
| Deformation degree of toner | G1 | G1 | G1 | G1 | G1 | G1 |

| | Example 7 | Example 8 | Example 9 | Example 10 | Comparative Example 1 | Comparative Example 2 |
|---|---|---|---|---|---|---|
| Crystalline polyester resin | (3) | (4) | (2) | (2) | (1) | (1) |
| Low-molecular compound | Dimethyl 2,6-naphthalene-dicarboxylate | Dimethyl 2,6-naphthalene-dicarboxylate | Dimethyl 2,6-naphthalene-dicarboxylate | Dimethyl 4,4'-diphenyl-dicarboxylate | None | 12-Hydroxy stearic acid |
| Addition amount (g) to 80 g of crystalline resin | 4.8 | 4.8 | 10 | 10 | 2.4 | 2.4 |
| Crystalline resin latex | Latex (7) | Latex (8) | Latex (9) | Latex (10) | Latex (1) | Latex (1) |
| Toner | Toner (7) | Toner (8) | Toner (9) | Toner (10) | Toner (11) | Toner (12) |
| Charge amount (under high temperature & high humidity) | 24 | 24 | 20 | 21 | 16 | 18 |
| Charge amount (under low temperature & low humidity) | 32 | 34 | 33 | 36 | 35 | 30 |
| MFT (° C.) | 100 | 100 | 100 | 100 | 100 | 100 |
| Deformation degree of toner | G2 | G3 | G3 | G3 | G4 | G4 |

As results in Table 1, by using crystal polyester resins used in Examples 1 to 10, and mixing a prescribed low-molecular compound, a toner which has property excellent in low temperature fixability and charge stability under the high temperature high humidity environment, and is hardly deformed in a developing machine can be obtained. On the other hand, in Comparative Examples, since a prescribed low-compound is not used, toner deformation is severe, and practical performance as a toner for a printer which outputs a print of high image quality can not be satisfied.

Example 11

1.5 parts by mass of the toner for electrophotography (1) of Example 1 and 30 parts by weight of a carrier (carrier for DC400, manufactured by Fuji Xerox Co., Ltd.) are mixed to prepare a developer for electrophotography.

Using the above developer for electrophotography as a developer of "Docu Print C 3530" manufactured by Fuji Xerox Co., Ltd., a printing test is performed at full color, and cleanability and a blade sound are assessed. As an undercoating layer, a charge generating layer and a charge transporting layer of a photoreceptor, those for Docu Print C 3530 were used, a thickness of an electrically conductive substrate is 1.4 mm and a fluorine-based resin particle is contained in a surface layer. And, a blade linear pressure of a cleaning blade for a photoreceptor is 20 g/cm$^2$, and a blade abutting angle is 9°.

<Assessment of Cleanability>

Under the environment of 10° C./15% RH, after one print of a whole surface solid image is printed by A3 longitudinal supply, one print of a whole surface of white paper is adopted, and the presence or the absence of a cleaning defect is determined with naked eyes.

<Assessment of Blade Sound>

Under the environment of 28° C./85% RH, 500 prints of an image density of 1% are printed by one supplying mode, and blade sound is organoleptically assessed by a measurer.

Results of the aforementioned assessment are all better. That is, a cleaning defect is not generated, and a blade sound is not generated.

What is claimed is:

1. A toner for electrophotography comprising a binder resin and a coloring agent, characterized in that the binder resin contains a crystalline polyester resin and a low-molecular compound having a biphenyl skeleton, and the crystalline polyester resin contains 0.5 to 30 construction mole % of an aromatic dicarboxylic acid-derived constitutional component.

2. The toner for electrophotography of claim 1, wherein the low-molecular compound is a compound selected from the group represented by the following formula (1):

formula (1)

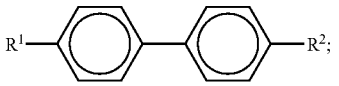

wherein in the above formula (1), it is preferable that $R^1$ and $R^2$ are independently a substituent represented by "—$COOR^3$", "—$CH_2COOR^4$" or "—$CONHR^5$". It is preferable that $R^3$, $R^4$ and $R^5$ are independently hydrogen, an alkyl group of $C_1$ to $C_{12}$.

3. The toner for electrophotography of claim 1, wherein the low-molecular compound is a compound selected from the group consisting of biphenyl, 4-biphenylacetic acid, 4-biphenylcarbonitrile, 4-biphenylcarboxylic acid, 4,4'-biphenyldicarboxylic acid, and alkyl esters thereof.

4. The toner for electrophotography of claim 1, wherein the low-molecular compound is contained at 1 to 12 parts by mass relative to 100 parts by mass of the crystalline polyester resin.

5. The toner for elctrophotography of claim 1, wherein the crystalline polyester resin contains two or more kinds of dicarboxylic acid-derived constitutional components.

6. The toner for electrophotography of claim 1, wherein the crystalline polyester resin contains an aliphatic dicarboxylic acid-derived constitutional component and an aromatic dicarboxylic acid-derived constitutional component as acid-derived constitutional components.

7. The toner for electrophotography of claim 6, wherein the aliphatic dicarboxylic acid-derived constitutional component is a straight-chain dicarboxylic acid-derived constitutional component.

8. The toner for electrophotography of claim 1, wherein the crystalline polyester resin contains a dicarboxylic acid-derived constitutional component having a double bond or a dicarboxylic acid-derived constitutional component having a sulfonic acid group as an acid-derived constitutional component.

9. The toner for electrophotography of claim 8, wherein the dicarboxylic acid-derived constitutional component having a double bond is 2 to 10 constitutional mole % of all acid-derived constitutional components.

10. The toner for electrophotography of claim 1, wherein the crystalline polyester resin contains an aliphatic diol-derived constitutional component as an alcohol-derived constitutional component.

11. The toner for electrophotography of claim 10, wherein the aliphatic diol-derived constitutional component contains a diol-derived constitutional component having a double bond.

12. The toner for electrophotography of claim 10, wherein the aliphatic diol-derived constitutional component is 80 construction mole % or more of an alcohol-derived constitutional component.

13. The toner for electrophotography of claim 10, wherein the aliphatic diol-derived constitutional component is a stright-chain aliphatic diol-derived constitutional component.

14. A developer for electrophotography comprising a toner for electrophotography and a carrier, characterized in that the toner for electrophotography is a toner for electrophotography as defined in claim 1.

15. An image forming method, comprising forming an electrostatic latent image on a surface of a latent image retaining body, developing the electrostatic latent image with a developer to form a toner image, transferring the toner image formed on the surface of the latent image retaining body onto a recording material to form a transferred image, and fixing the transferred image transferred onto the recording material, wherein the developer contains a toner for electrophotography as defined in claim 1.

16. The image forming method of claim 15, wherein the thickness of an electrically conductive substrate of the latent image retaining body is not less than 1.4 mm and not more than 2.2 mm.

17. The image forming method of claim 15, further comprising cleaning to remove a toner remaining on the surface of the latent image retaining body.

18. The image forming method of claim 17, wherein cleaning means is retained by a supporting member, and contains an elastic blade abutted against a surface of the latent image retaining body at an abutting pressure of a linear pressure of not less than 20 g/cm and not more than 40 g/cm.

19. The image forming method of claim 17, wherein an elastic blade is abutted against a surface of the latent image retaining body at an abutting angle of not less than 9° and not more than 17°.

* * * * *